US008403167B2

(12) United States Patent
Damaghi et al.

(10) Patent No.: US 8,403,167 B2
(45) **Date of Patent: *Mar. 26, 2013**

(54) DISPENSER LID WITH BIASING PIN AND CONTAINER INCLUDING THE SAME

(75) Inventors: Robin Damaghi, Great Neck, NY (US); William M. Child, Lock Haven, PA (US); Dan Allen Murray, Jersey Shore, PA (US)

(73) Assignee: Nutek Disposables, Inc., McElhattan, PA (US)

( * ) Notice: Subject to any disclaimer, the term of this patent is extended or adjusted under 35 U.S.C. 154(b) by 820 days.

This patent is subject to a terminal disclaimer.

(21) Appl. No.: 11/803,983

(22) Filed: May 16, 2007

(65) Prior Publication Data

US 2008/0041856 A1 Feb. 21, 2008

Related U.S. Application Data

(63) Continuation-in-part of application No. 11/434,962, filed on May 16, 2006, now Pat. No. 8,245,865.

(51) Int. Cl.
*B65D 81/18* (2006.01)
*B65D 43/26* (2006.01)

(52) U.S. Cl. ..... 220/254.3; 220/262; 220/324; 220/827; 220/841

(58) Field of Classification Search ..... 220/262–264, 220/254.5, 254.3, 254.7, 829, 827, 844, 843, 220/832, 845; 16/225, 277; 206/438
See application file for complete search history.

(56) References Cited

U.S. PATENT DOCUMENTS 755,085 A 3/1904 Viano
825,133 A 7/1906 Klenk
1,926,240 A 9/1933 Maas
2,004,449 A 6/1935 Stanley
2,216,147 A 10/1940 Ward
2,718,250 A 9/1955 Bradford
2,891,704 A 6/1959 Morrison
3,380,616 A 4/1968 Schoeller
3,541,730 A * 11/1970 Ballantyne ..... 49/386
3,558,002 A 1/1971 Lindgren
3,780,908 A 12/1973 Fitzpatrick et al.
3,941,301 A 3/1976 Jorgensen
3,967,756 A 7/1976 Barish
3,982,659 A 9/1976 Ross
3,986,479 A 10/1976 Bonk
4,156,493 A 5/1979 Julius
4,185,754 A 1/1980 Julius
4,252,268 A 2/1981 Haire
4,458,810 A 7/1984 Mahoney
4,552,269 A 11/1985 Chang
4,553,665 A 11/1985 Weick et al.
(Continued)

*Primary Examiner* — Robin Hylton
(74) *Attorney, Agent, or Firm* — Amster, Rothstein & Ebenstein LLP

(57) ABSTRACT

A container including a bottom and a plurality of walls that form a storage cavity. A primary lid is disposed over the storage cavity. The primary lid includes a top surface that defines a dispenser portion through which items within the storage cavity may be dispensed. A dispenser lid is pivotally attached to the primary lid. The dispenser lid has a closed position in which the dispenser lid is pivoted downwards relative to the primary lid to cover the dispenser portion and an open position in which the dispenser lid is pivoted upwards relative to the primary lid to expose the dispenser portion. The dispenser lid includes a pivot end portion and an opposite free end portion, and a biasing pin extending from the pivot end portion. The biasing pin has a longitudinal end portion anchored to the primary lid so that the biasing pin urges the dispenser lid towards the open position. The biasing pin and a main dispenser lid portion are formed as a unitary structure.

5 Claims, 26 Drawing Sheets

U.S. PATENT DOCUMENTS

| | | | | | |
|---|---|---|---|---|---|
| D283,312 | S | | 4/1986 | Ebrahim | |
| D284,944 | S | | 8/1986 | Carlson | |
| D285,413 | S | | 9/1986 | Carlson | |
| 4,660,734 | A | | 4/1987 | Heaney et al. | |
| 4,739,900 | A | | 4/1988 | Borst | |
| 4,790,436 | A | | 12/1988 | Nakamura et al. | |
| 4,817,790 | A | | 4/1989 | Porat et al. | |
| 4,848,575 | A | | 7/1989 | Nakamura et al. | |
| 4,848,580 | A | | 7/1989 | Wise | |
| 4,892,220 | A | | 1/1990 | Foos | |
| 4,967,908 | A | | 11/1990 | Kessler | |
| 5,029,725 | A | | 7/1991 | Roth | |
| 5,050,742 | A | | 9/1991 | Muckenfuhs | |
| 5,065,887 | A | * | 11/1991 | Schuh et al. | 220/835 |
| 5,356,025 | A | * | 10/1994 | Renault | 220/263 |
| 5,501,348 | A | * | 3/1996 | Takeuchi | 215/235 |
| 5,520,302 | A | | 5/1996 | Anderson et al. | |
| 5,542,567 | A | | 8/1996 | Julius | |
| 5,542,568 | A | | 8/1996 | Julius | |
| 5,573,132 | A | | 11/1996 | Kanfer et al. | |
| 5,582,294 | A | | 12/1996 | Yamada | |
| 5,624,051 | A | | 4/1997 | Ahern et al. | |
| 5,699,912 | A | | 12/1997 | Ishikawa et al. | |
| 5,704,471 | A | | 1/1998 | Yamada | |
| 5,729,955 | A | | 3/1998 | Yamada | |
| 5,785,179 | A | | 7/1998 | Buczwinski et al. | |
| 5,860,742 | A | | 1/1999 | Faircloth, Jr. | |
| 5,938,069 | A | | 8/1999 | Macchia | |
| 5,996,797 | A | | 12/1999 | Flaig | |
| 5,996,800 | A | | 12/1999 | Pratt | |
| 6,032,827 | A | | 3/2000 | Zettle et al. | |
| 6,065,626 | A | | 5/2000 | Huang et al. | |
| 6,152,322 | A | | 11/2000 | Marino | |
| 6,206,221 | B1 | | 3/2001 | Bando et al. | |
| D446,719 | S | | 8/2001 | Garraway | |
| 6,269,969 | B1 | | 8/2001 | Huang et al. | |
| 6,299,017 | B1 | | 10/2001 | Hill | |
| 6,394,298 | B1 | | 5/2002 | Zaidman | |
| 6,401,968 | B1 | | 6/2002 | Huang et al. | |
| 6,412,634 | B1 | | 7/2002 | Telesca et al. | |
| 6,431,360 | B1 | | 8/2002 | Julius | |
| D466,299 | S | | 12/2002 | Zimmerman | |
| 6,499,626 | B1 | | 12/2002 | Julius | |
| 6,520,331 | B2 | | 2/2003 | Okin et al. | |
| 6,554,156 | B1 | | 4/2003 | Chong | |
| 6,729,498 | B2 | | 5/2004 | Yelton et al. | |
| 6,767,604 | B2 | | 7/2004 | Muir, Jr. et al. | |
| D501,722 | S | | 2/2005 | Zimmerman | |
| 6,868,980 | B2 | | 3/2005 | Schultz et al. | |
| 6,889,867 | B1 | | 5/2005 | Smith | |
| 6,902,077 | B1 | | 6/2005 | Tack et al. | |
| 6,910,579 | B2 | | 6/2005 | Reinke et al. | |
| 6,951,292 | B2 | | 10/2005 | Bando et al. | |
| 6,971,542 | B2 | | 12/2005 | Vogel et al. | |
| 7,000,792 | B2 | * | 2/2006 | Arai | 215/237 |
| 7,021,483 | B2 | | 4/2006 | Tack et al. | |
| 7,025,220 | B2 | | 4/2006 | Verespej et al. | |
| 2003/0080018 | A1 | | 5/2003 | Nally | |
| 2004/0016671 | A1 | | 1/2004 | Wang et al. | |
| 2004/0035738 | A1 | | 2/2004 | Julius | |
| 2004/0035867 | A1 | | 2/2004 | Schultz et al. | |
| 2004/0089578 | A1 | | 5/2004 | Lin | |
| 2004/0222119 | A1 | | 11/2004 | Alexander et al. | |
| 2005/0011906 | A1 | | 1/2005 | Buck et al. | |
| 2005/0067313 | A1 | | 3/2005 | Banik et al. | |
| 2005/0092764 | A1 | | 5/2005 | Chasid et al. | |
| 2005/0092765 | A1 | | 5/2005 | Chasid et al. | |
| 2005/0150785 | A1 | | 7/2005 | Julius et al. | |
| 2005/0189367 | A1 | | 9/2005 | Chasid et al. | |
| 2005/0205594 | A1 | | 9/2005 | Evans et al. | |
| 2005/0207680 | A1 | | 9/2005 | Schumacher et al. | |
| 2005/0236416 | A1 | | 10/2005 | Reinke et al. | |
| 2005/0258062 | A1 | | 11/2005 | Bando | |
| 2005/0263534 | A1 | | 12/2005 | Wu et al. | |
| 2006/0096984 | A1 | | 5/2006 | Bandoh et al. | |

* cited by examiner

DISPENSER LID WITH BIASING PIN AND CONTAINER INCLUDING THE SAME

RELATED APPLICATIONS

This application is a continuation-in-part of U.S. patent application Ser. No. 11/434,962, filed May 16, 2006 now U.S. Pat. No. 8,245,865, the contents of which are incorporated herein by reference.

TECHNICAL FIELD

The present invention is generally related to containers. More specifically, the present invention relates to flexible sheet containers having a dispenser lid.

BACKGROUND

Flexible sheet containers are well known and come in a variety of shapes and sizes. Portable flexible sheet containers, such as baby wipes containers, cleaning towels containers, and the like are popular for their mobility. Dispensing versions of these containers are particularly popular for their ease of use. They are convenient in situations where a user needs to quickly and repeatedly grab wipes or towels. For example, when a messy spill occurs, it is desirable for a user to quickly and easily grab successive cleaning towels as needed while cleaning the spill. In other situations, it may be desirable for a user, such as a parent changing a child's diaper, to be able to grab successive wipes with minimal complexity.

Ideally, flexible sheet containers should have a relatively simple design so as to allow a user to conveniently and quickly dispense a flexible sheet. As the same time, users typically desire such containers to have a compact design and a pleasing appearance so that they can be conveniently stored on a bathroom shelf or in other areas of the home. For example, such containers typically have a dispenser opening, and access to the dispenser opening should be as easy as possible to maximize convenience to a user. Accordingly, there is a need for a flexible sheet container design that provides for easy access to stored flexible sheets, while still exhibiting a compact and aesthetically pleasing appearance.

SUMMARY OF THE INVENTION

A container according to an exemplary embodiment of the present invention includes a bottom and a plurality of walls that form a storage cavity. A primary lid is disposed over the storage cavity. The primary lid includes a top surface that defines a dispenser portion through which items within the storage cavity may be dispensed. A dispenser lid is pivotally attached to the primary lid. The dispenser lid has a closed position in which the dispenser lid is pivoted downwards relative to the primary lid to cover the dispenser portion and an open position in which the dispenser lid is pivoted upwards relative to the primary lid to expose the dispenser portion. The dispenser lid comprises a pivot end portion and an opposite free end portion, and a biasing pin extending from the pivot end portion. The biasing pin has a longitudinal end portion anchored to the primary lid so that the biasing pin urges the dispenser lid towards the open position.

In at least one embodiment, the dispenser lid and the biasing pin form a unitary structure.

In at least one embodiment, the top surface of the primary lid is defined by a top wall, and the primary lid comprises an opening in the top wall into which the biasing pin is inserted to anchor the dispenser lid to the primary lid.

In at least one embodiment, the biasing pin further comprises a first flange formed at the end portion, and a second flange longitudinally spaced from the first flange to thereby form a groove between the first and second flanges, the width of the second flange gradually increasing towards the groove, the end portion of the biasing pin being inserted into the opening formed in the primary lid such that edges of the top wall that define the opening are inserted into the groove.

In at least one embodiment, a catch plate is disposed on the primary lid that locks the dispenser lid in the closed position.

A method of constructing a container according to an exemplary embodiment of the present invention comprises the steps of: disposing a primary lid over a storage cavity defined by a bottom and a plurality of walls, the primary lid including a top surface that defines a dispenser portion through which items within the storage cavity may be dispensed; forming a dispenser lid having a main dispenser lid portion including a pivot end portion and an opposite free end portion, and a biasing pin extending from the pivot end portion, the biasing pin having a longitudinal end portion; pivotally attaching the pivot end portion of the dispenser lid to the primary lid so that the dispenser lid has a closed position in which the dispenser lid is pivoted downwards relative to the primary lid to cover the dispenser portion and an open position in which the dispenser lid is pivoted upwards relative to the primary lid to expose the dispenser portion, and anchoring the biasing pin to the primary lid so that the biasing pin urges the dispenser lid towards the open position.

In at least one embodiment, the step of forming the dispenser lid comprises molding the main dispenser lid portion and the biasing pin as a unitary structure.

In at least one embodiment, the molding is injection molding.

In at least one embodiment, the molding is two-shot molding.

These and other features of this invention are described in, or are apparent from, the following detailed description of various exemplary embodiments of this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
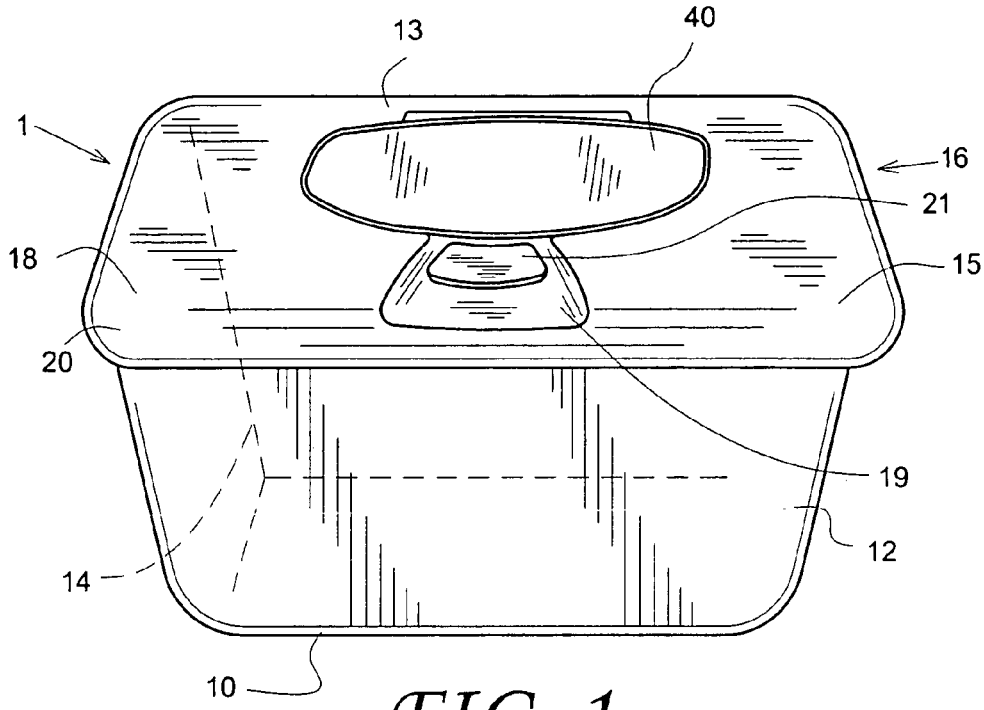
FIG. 1 is a perspective view of a container according to an exemplary embodiment of the present invention.

FIG. 1 shows a container, generally designated by reference number 1, according to an exemplary embodiment of the present invention. The container 1 is generally rectangular in shape, but of course may have any other suitable shape, and includes a bottom 10 and a plurality of walls 12 that define a storage cavity 14 for storing flexible sheets, such as, for example, wet wipes. The various elements of the container 1 are preferably made of a flexible plastic material, such as, for example, polypropylene.

Figure 2:
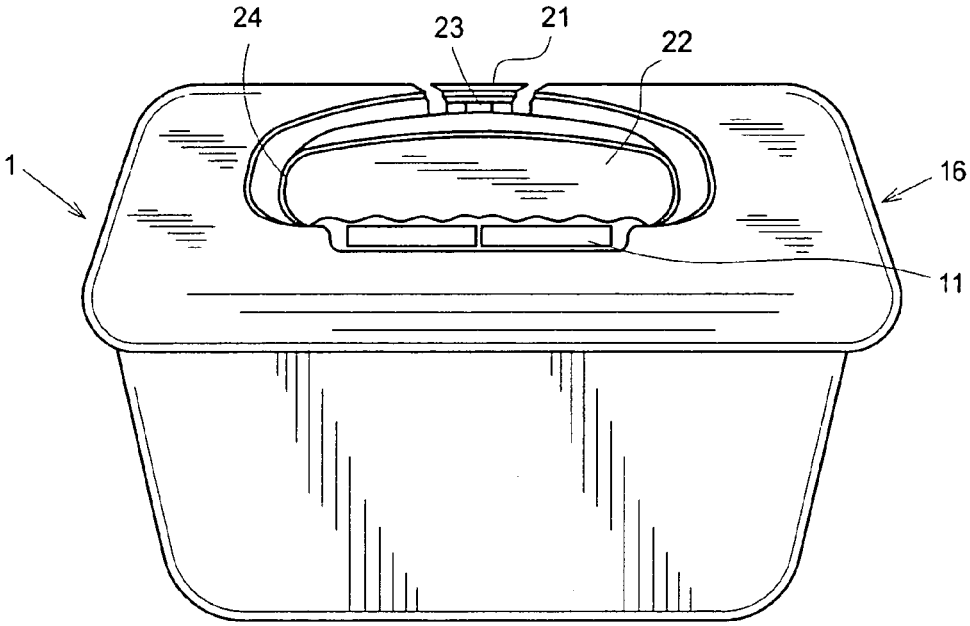
FIG. 2 is another perspective view of the container of FIG. 1 with the dispenser lid removed.
Figure 3:
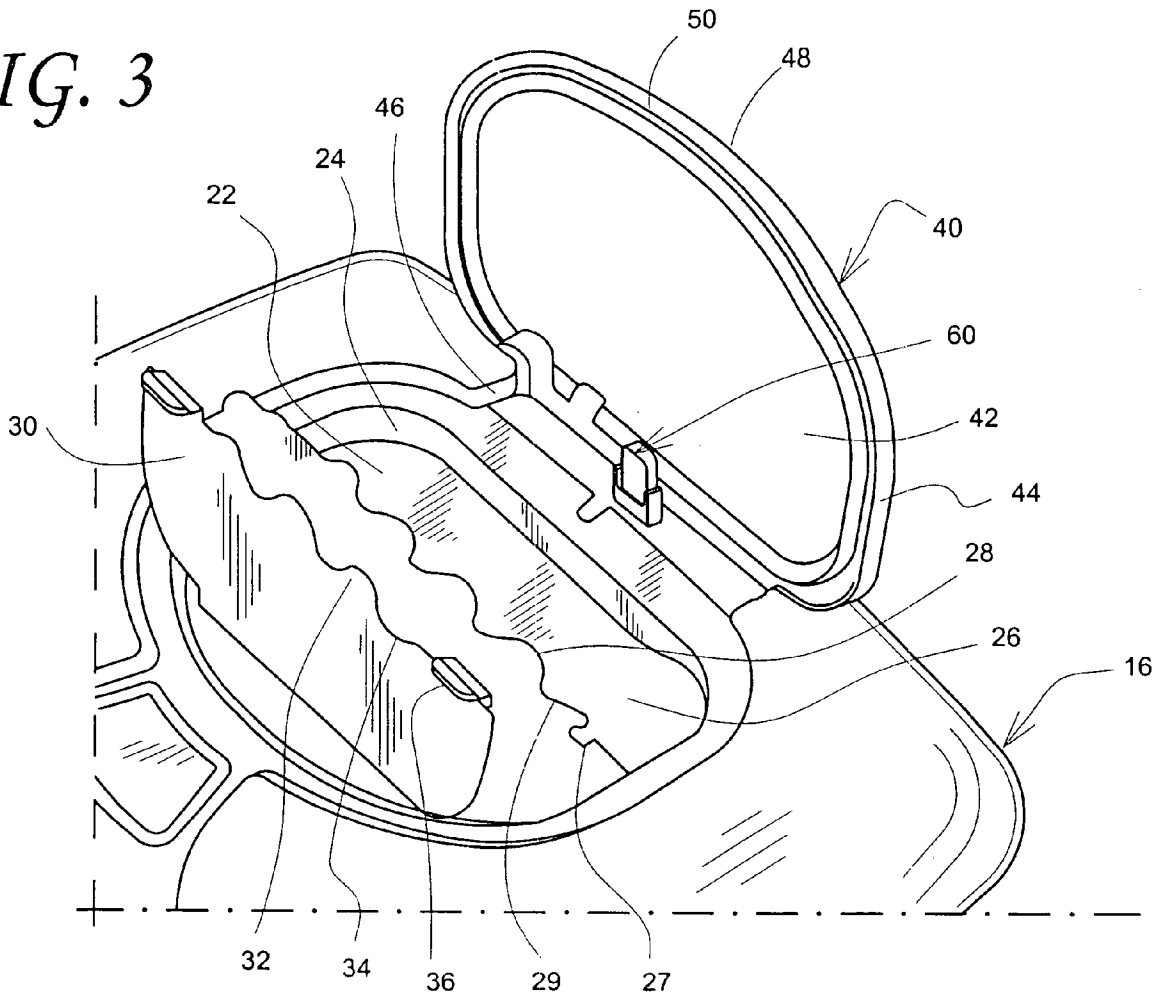
FIG. 3 is a partial detailed perspective view of the container of FIG. 1.
Figure 6:
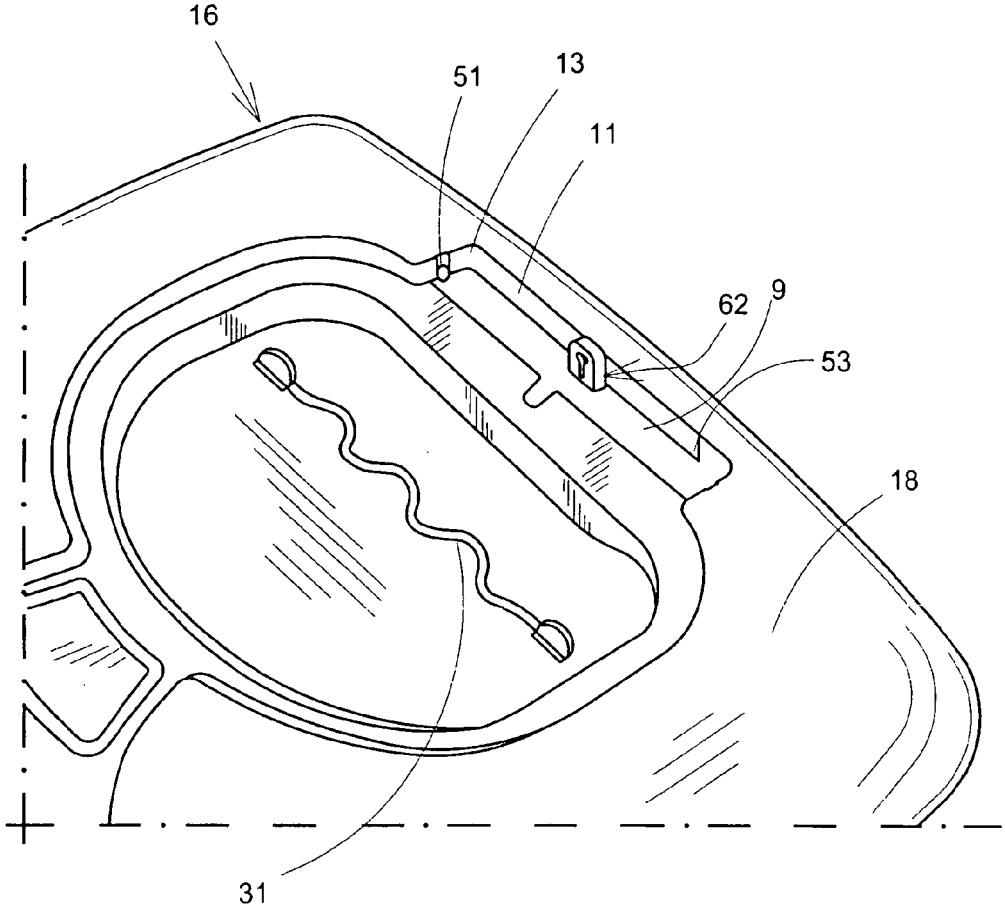
FIG. 6 is a partial detailed perspective view of the container of FIG. 1 with prior to attachment of the dispenser lid.

The container 1 further includes a removable primary lid, generally designated by reference number 16, that is placed over the storage cavity 14, and a dispenser lid, generally designated by reference number 40, pivotally attached to the primary lid 16. It should be appreciated that the primary lid 16 may also be pivotally attached to the container 1. The primary lid 16 includes a top surface 18, a back portion 13, a front portion 15 and downwardly extending side walls 20. The inner surfaces of the side walls 20 preferably include flanged portions (not shown) that can be snap fit over corresponding flanged portions (not shown) formed at the upper rim of the storage cavity 14 to hold the primary lid 16 in place over the storage cavity 14. As shown in FIGS. 2 and 3, the primary lid 16 further includes a recessed dispenser portion, generally designated by reference number 22, that permits flexible sheets stored in the storage cavity 14 to be dispensed. The dispenser portion 22 includes internal side walls 24 and a bottom wall 26 having a free edge 28. A flap 30 is pivotally attached to a side wall 24 of the dispenser portion 22 by, for example, a living hinge (not shown). The flap 30 has a free edge 32. The free edge 28 of the bottom wall 26 is contoured so as to define a number of projections 29. Likewise, the free edge 32 of the flap 30 is contoured so as to define a number of recessed portions 34. When the flap 30 is in the closed position it is generally co-planar with the bottom wall 26 and an aperture 31 is formed as defined by the free edge 32 of the flap 30 and the free edge 28 of the bottom wall 26, as best shown in FIG. 6. Although the aperture 31 is shown as a narrow slit, it should be appreciated that the specific shape of the aperture 31, as defined by the closely juxtaposed free edges 28, 32, projections 29 and recessed portions 34, is not significant, provided that the aperture 31 is capable of grasping and retaining an article in a dispensed or pop-up position.

Prior to use, the flap 30 can be pivoted upwards to expose the topsheet of a stack of sheets stored in the storage cavity 14, as shown in FIG. 3. Once the topsheet is partially pulled upwards out of the storage cavity 14, the flap 30 can be pivoted downwards so that it is generally co-planar with the bottom wall 26, and the projections 29 of the bottom wall mate with the recessed portions 34 of the flap 30 to trap the topsheet therebetween. A user may then later completely remove the topsheet for use, which will result in a subsequent sheet being dispensed out of the storage cavity 14 due to the stacking arrangement of the sheets. When in the downward position, the flap 30 is prevented from rotating into the storage cavity 14 by rotation limiters, such as stop surface 27 formed at the free edge 28 of the bottom wall 26 that engage with tabs 36 formed at the free edge 32 of the flap 30. Preferably, the rotation limiters also prevent the flap 30 from being lifted upwards when a sheet is being dispensed from the storage cavity 14.

The top surface 18 of the primary lid 16 also includes a first recessed portion 19 at the front portion 15 of the primary lid 16. A catch plate 21 is pivotally attached to the top surface 18 within the recessed portion 19 by, for example, a living hinge. The top surface of the catch plate 21 is generally co-planar with the non-recessed areas of the top surface 18 of the primary lid 16 when the catch plate 21 is in its non-pivoted, biased position. As explained more fully below, the catch plate 21 includes a tab receptor 23 that functions to lock the dispenser lid 40 in the closed position.

As shown most clearly in FIG. 6, the top surface 18 of the primary lid 16 further includes a second recessed portion, generally designated by reference number 11, at the back portion 13. The second recessed portion 11 includes a bottom wall 9. A lateral side wall of the second recessed portion 11 includes a first pivot pin receptacle 51 and an opposite lateral side wall of the second recessed portion 11 includes a second pivot pin receptacle 53.

As shown in FIG. 3, the dispenser lid 40 is pivotally attached to the top portion 18 of the primary lid 16. The dispenser lid 40 has the same general profile as that of the dispenser portion 22, so that when the dispenser lid 40 is pivoted downwards it covers the dispenser portion 22 to provide the container 1 with a more compact shape when in storage. The dispenser lid 40 includes a bottom surface 42, side surfaces 44, a pivot end portion 46 and an opposite free end portion 48. A tab 50 extends from a side surface 44 at the free end portion 48 of the dispenser lid 40. The dispenser lid 40 can be locked in position over the dispenser portion 22 by pivoting the dispenser lid 40 downwards until the tab 50 can be inserted into the tab receptor 23 in the catch plate 21. In this regard, the catch plate 21 can be pivoted such that the tab 50 is free to fall below the top surface of the catch plate 21 and into the tab receptor 23 Likewise, the dispenser lid 40 can be unlocked by pivoting the catch plate 21 such that the tab 50 is free to raise out of the tab receptor 23, thereby allowing the dispenser lid 40 to be pivoted upwards relative to the primary lid 16. The dispenser lid 40 and catch plate 21 may have any other configuration and number of tabs and receptors to allow for locking of the dispenser lid 40 in the closed position.

Figure 7:
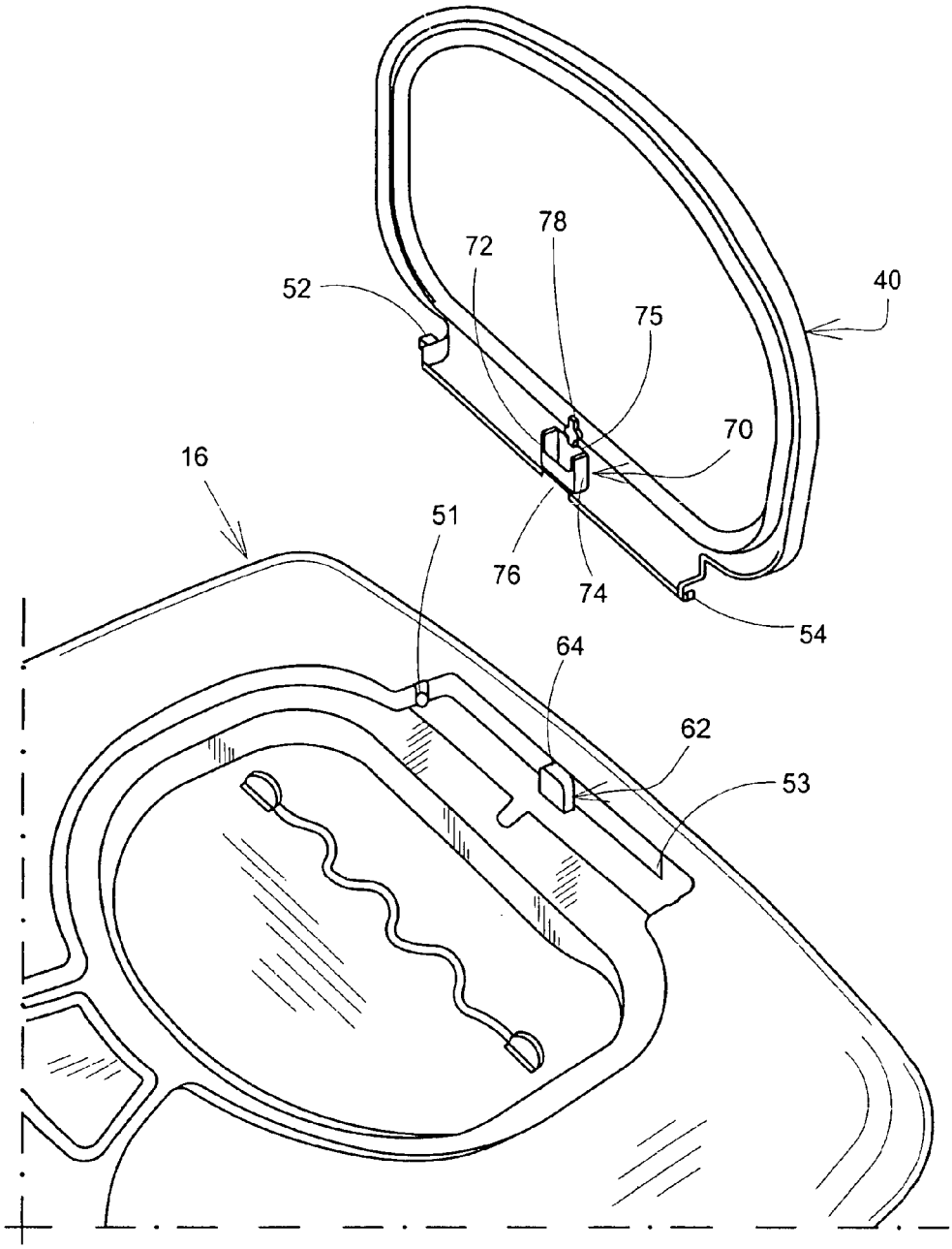
FIG. 7 is a partial detailed perspective view of the container of FIG. 1 showing the dispenser lid being attached to the primary lid.

As shown in FIG. 7, the dispenser lid 40 includes a first pivot pin 52 extending from a lateral side of the pivot end portion 46 and a second pivot pin 54 extending from an opposite lateral side of the pivot end portion 46. The first pivot pin 52 is received within the first pivot pin receptacle 51 and the second hinge pin 54 is received within the second pivot pin receptacle 53, thereby pivotally attaching the dispenser lid 40 to the primary lid 16.

Figure 5:
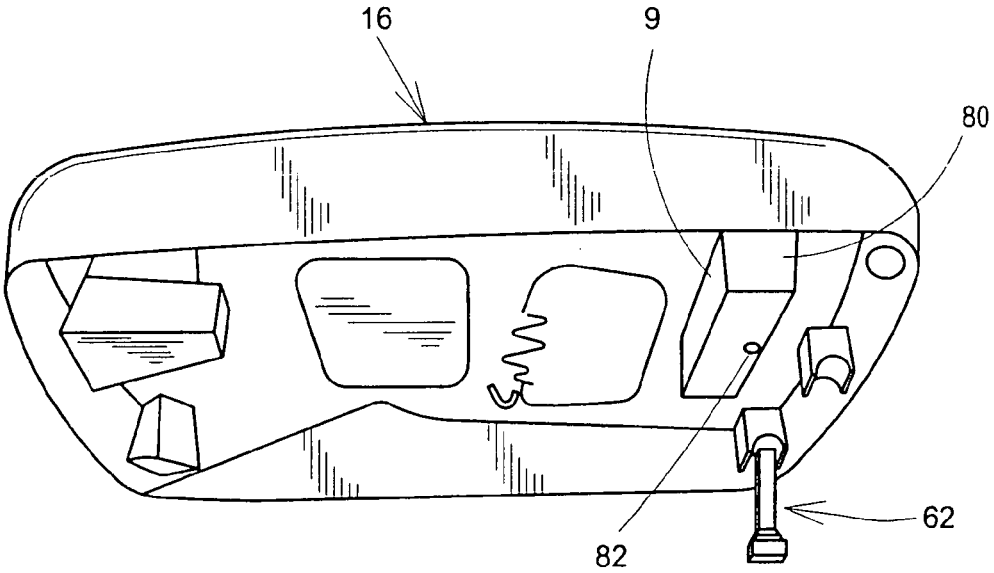
FIG. 5 is a perspective view showing the bottom surface of the primary lid of the container of FIG. 1.

The container 1 also includes a dispenser lid biasing means, generally designated by reference number 60, that biases the dispenser lid 40 in the open position. The biasing means 60 includes a biasing pin, generally designated by reference number 62, a first biasing pin anchor, generally designated by reference number 70, located at the pivot end portion 46 of the dispenser lid 40, and a second biasing pin anchor, generally designated by reference number 80, located within the second recessed portion 11 of the primary lid 16. As shown most clearly in FIG. 7, the first biasing pin anchor 70 includes first and second parallel guide walls 72, 74 that form a guide groove 75 extending across the pivot end portion 46 of the dispenser lid 40, a pivot bar 76 extending laterally between the guide walls 72, 74, and a protrusion 78 extending from the bottom surface 42 of the dispenser lid 40 adjacent to the groove 75. The second biasing pin anchor 80 includes an opening 82 formed within the bottom wall 9 of the second recessed portion 11 of the primary lid 16, as shown in FIG. 5.

Figure 4:
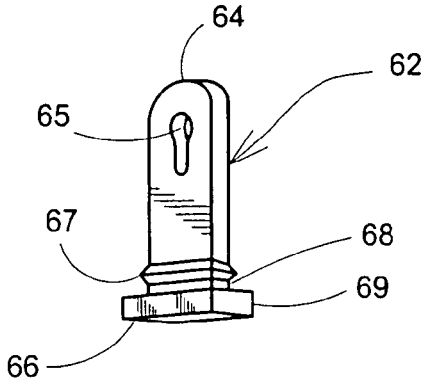
FIG. 4 is a perspective view of a biasing pin used with the container of FIG. 1.

FIG. 4 shows a detailed view of the biasing pin 62 according to an exemplary embodiment of the invention. The biasing pin 62 is generally an elongated element including an upper end 64 and a lower end 66. An elongated opening 65 is formed adjacent to the upper end 64. An upper flange 67 and a lower flange 69 are formed adjacent to the lower end 66. The upper and lower flanges 67, 69 form a groove 68 therebetween. The upper flange 67 gradually expands away from the general plane of the biasing pin towards the lower end 66 so as to provide a ramp-like profile. In contrast, the lower flange 69 has a more abrupt profile that is wider than the other portions of the biasing pin 62 except for the widest portion of the upper flange 67.

Figure 8:
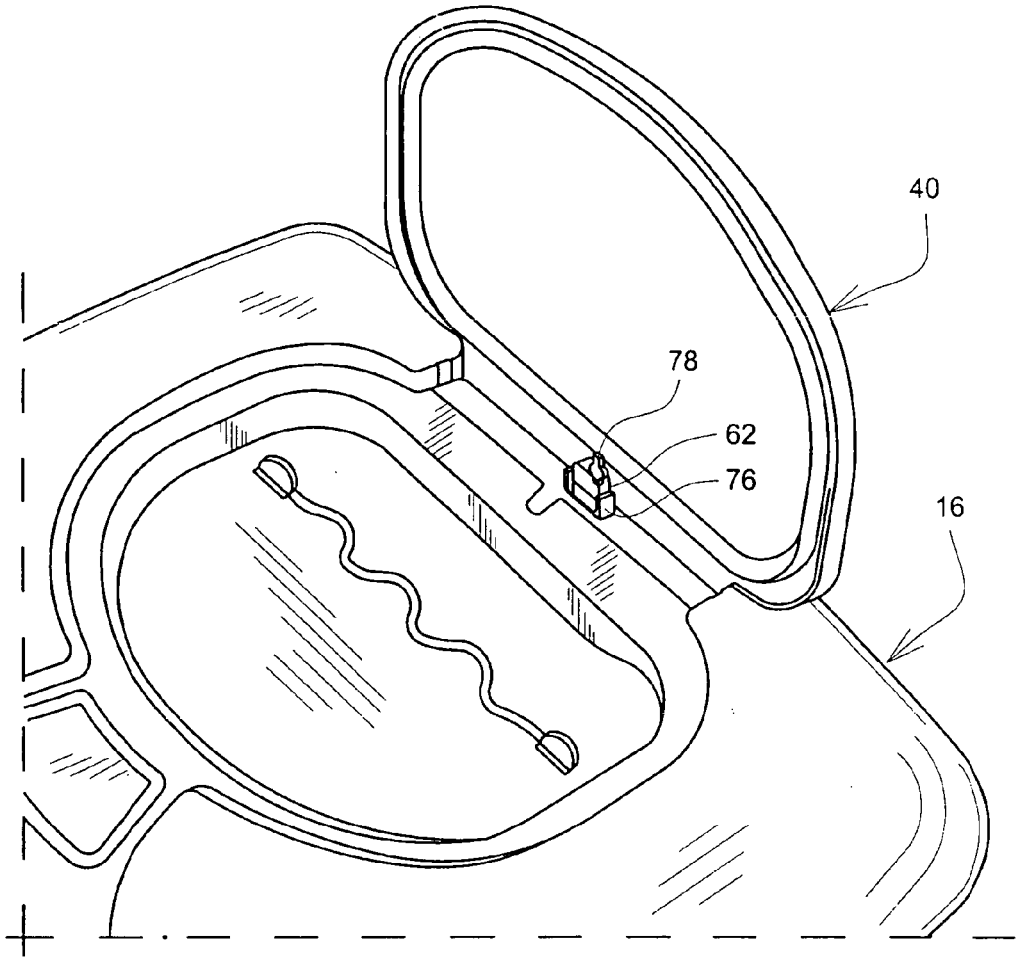
FIG. 8 is a partial detailed perspective view of the container of FIG. 1 showing the dispenser lid being attached to the primary lid.
Figure 9:
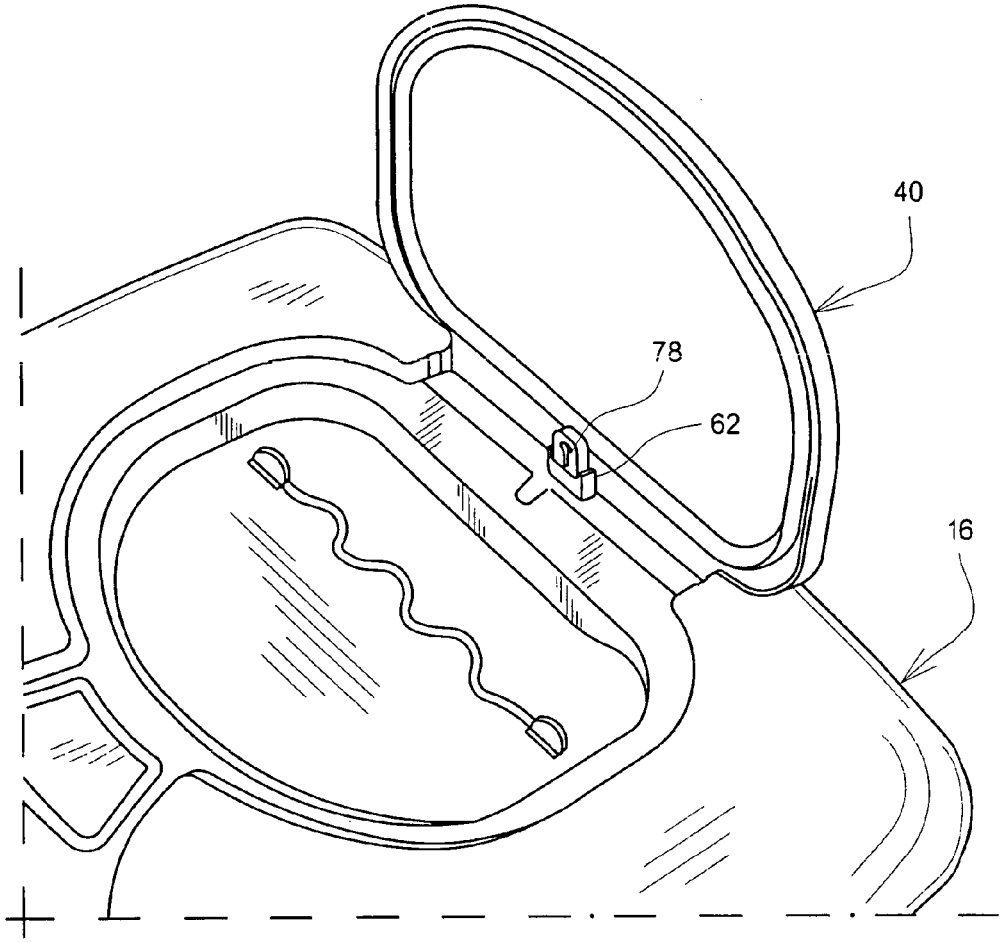
FIG. 9 is a partial detailed perspective view of the container of FIG. 1 showing the dispenser lid attached to the primary lid.

A method of assembling the dispenser lid 40 onto the primary lid 16 according to an exemplary embodiment of the invention will now be described with reference to FIGS. 5-9. As shown in FIGS. 5 and 6, the biasing pin 62 is first inserted from underneath the primary lid 16 into the opening 82. The opening 82 is preferably slightly smaller in width than the widest portion of the upper flange 67, so that the biasing pin 62 will flex inwards to allow the bottom wall 9 of the second recessed portion 11 to fall within the groove 68, thereby locking the biasing pin 62 with its upper end 64 extending perpendicular to the top surface 18 of the primary lid 16, as shown in FIG. 6. As shown in FIGS. 7-9, the upper end 64 of the biasing pin 62 is then "weaved" within the guide groove 75 formed on the dispenser lid 40 such that the biasing pin 62 is disposed between the pivot bar 76 and the bottom surface 42 of the dispenser lid 40 and the protrusion 78 extends through the elongated opening 65 formed in the biasing pin 62. Simultaneously, the first hinge pin 52 is disposed within the first pivot pin receptacle 51 and the second hinge pin 54 is disposed within the second pivot pin receptacle 53. The protrusion 78 is preferably ramp-shaped to facilitate engagement of the biasing pin 62.

Once the dispenser lid 40 is pivotally attached to the primary lid 16 in the manner discussed above, the rigidity of the biasing pin 62 results in the dispenser lid 40 being biased upwards relative to the primary lid 16. Specifically, when a user pivots the dispenser lid 40 downwards towards the primary lid 16, the biasing pin 62 bends around the pivot bar 76 against its naturally straightened configuration. As described above, the dispenser lid 40 can be locked in the closed position using the catch plate 21. Once the dispenser lid 40 is unlocked, the biasing pin 62 naturally flexes back to its straightened configuration, thereby urging the dispenser lid 40 to pivot away from the primary lid 16.

Figure 10:
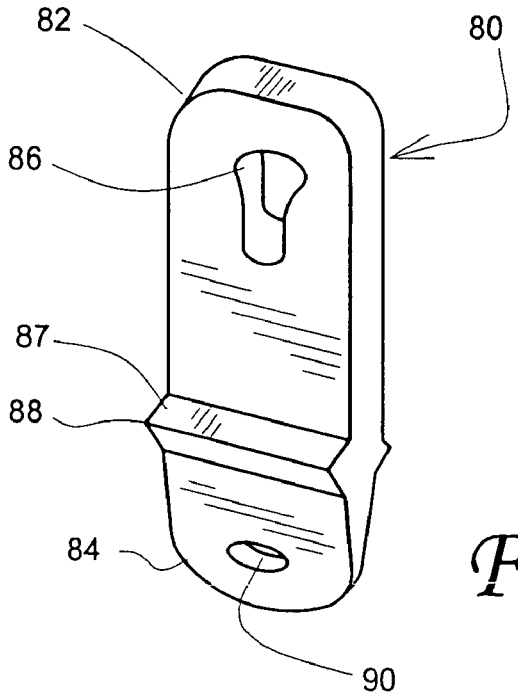
FIG. 10 is a perspective view of a biasing pin used with the container of FIG. 1.

FIG. 10 shows a biasing pin, generally designated by reference number 80, used in another exemplary embodiment of the invention. The biasing pin 80 is generally an elongated element including an upper end 82 and a lower end 84. An elongated opening 86 is formed adjacent to the upper end 82. An upper flange 87 and a lower flange 89 are formed adjacent to the lower end 84. The upper and lower flanges 87, 89 form a groove 88 therebetween. The upper flange 87 gradually expands away from the general plane of the biasing pin 80 towards the lower end 84, and the lower flange 89 gradually expands away from the general plane of the biasing pin 80 towards the upper end 82, so that both the upper and lower flanges 87, 89 provide ramp-like profiles. A pull hole 90 is formed in the biasing pin 80 between the lower flange 89 and the lower end 84.

Figure 11:
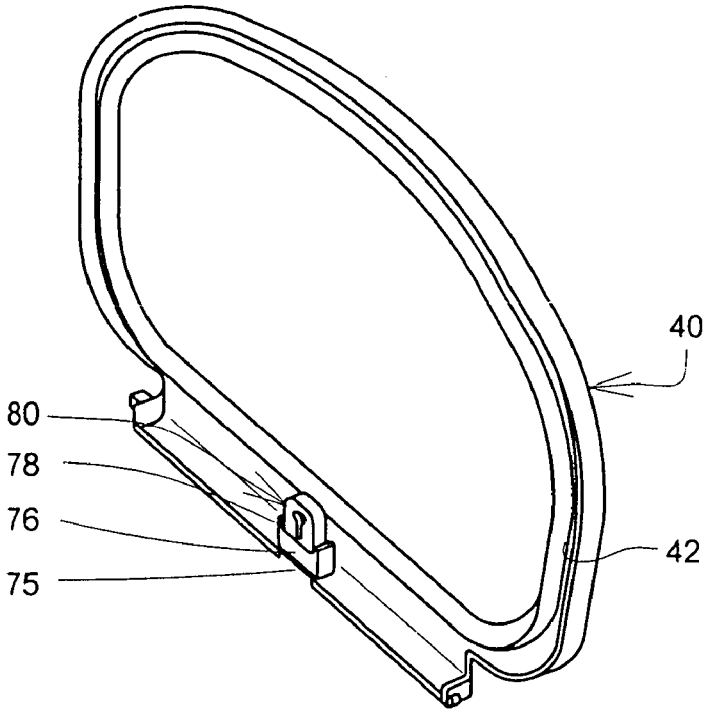
FIG. 11 is a perspective view of the dispenser lid of the container of FIG. 1 prior to attachment to the primary lid.
Figure 12:
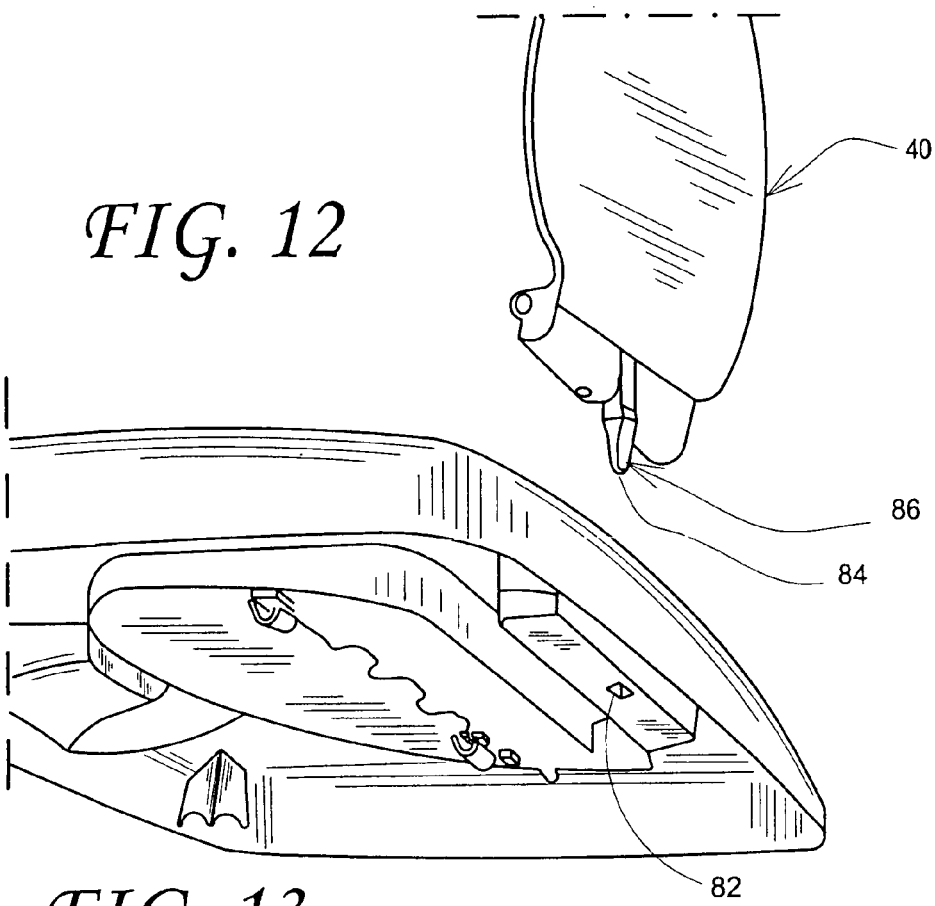
FIG. 12 is a perspective view of the dispenser lid being attached to the primary lid of the container of FIG. 1.
Figure 13:
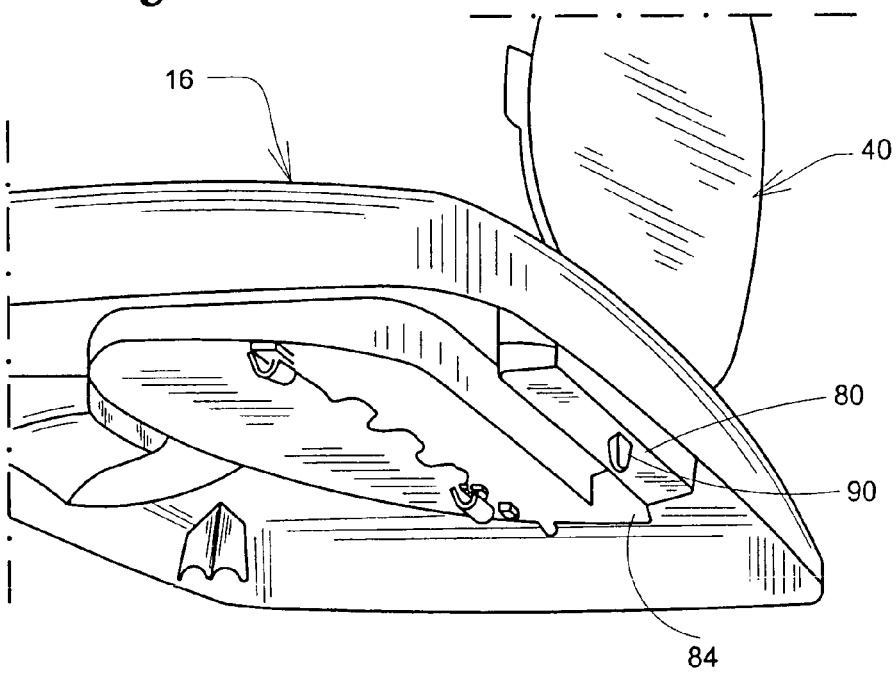
FIG. 13 is a perspective view of the dispenser lid being attached to the primary lid of the container of FIG. 1.
Figure 14:
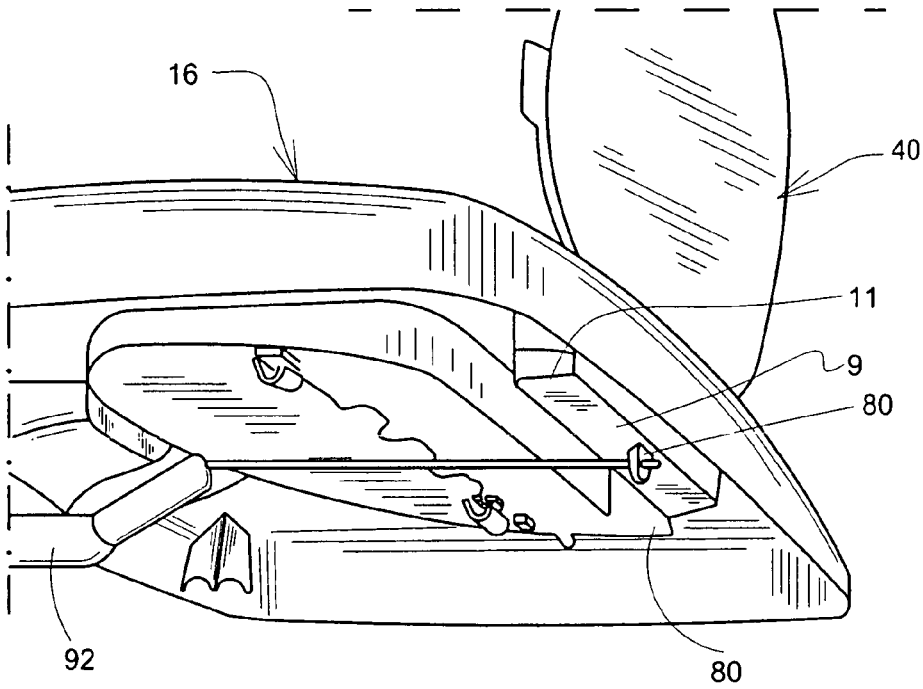
FIG. 14 is a perspective view of the dispenser lid being attached to the primary lid of the container of FIG. 1.

A method of assembling the dispenser lid 40 onto the primary lid 16 using the biasing pin 80 according to an exemplary embodiment of the invention will now be described with reference to FIGS. 11-14. As shown in FIG. 11, the biasing pin 80 is first "weaved" within the guide groove 75 formed on the dispenser lid 40 such that the biasing pin 80 is disposed between the pivot bar 76 and the bottom surface 42 of the dispenser lid 40 and the protrusion 78 extends through the elongated opening 86 formed in the biasing pin 80. Then, as shown in FIGS. 12 and 13, the lower end 84 of the biasing pin 80 is inserted into the opening 82 such that the pull hole 90 is exposed underneath the lower surface of the primary lid 16. As shown in FIG. 14, a manufacturing tool 92 can be inserted into the pull hole 90 and used to pull the biasing pin 80 downwards until the bottom wall 9 of the second recessed portion 11 falls into the groove 88 formed between the upper and lower flanges 87, 89. Simultaneously, the first hinge pin 52 is disposed within the first pivot pin receptacle 51 and the second hinge pin 54 is disposed within the second pivot pin receptacle 53 to complete the assembly of the dispenser lid 40 onto the primary lid 16. As in the previous embodiment, the biasing pin 80 biases the dispenser lid 40 upwards relative to the primary lid 16.

Figure 15:
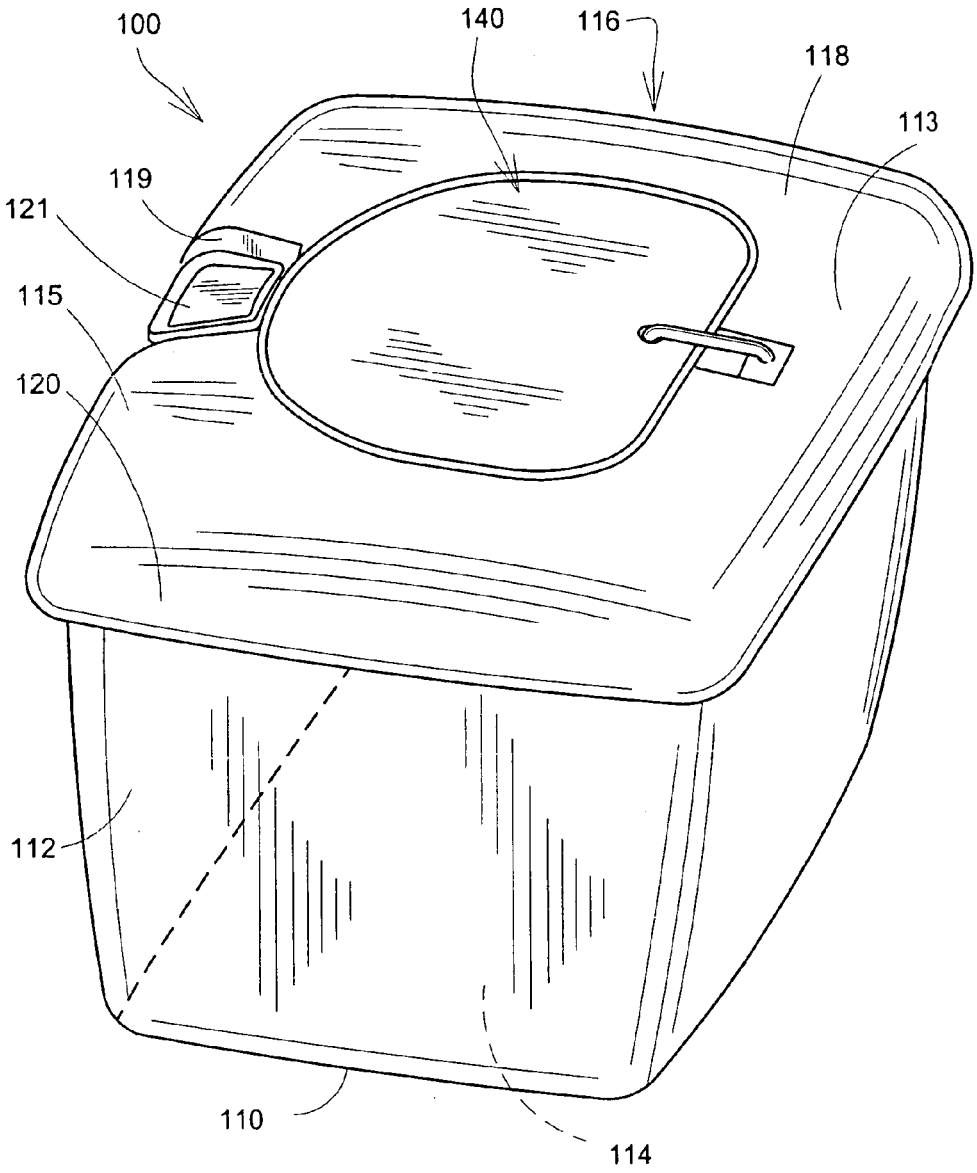
FIG. 15 is a perspective view of a container according to another exemplary embodiment of the present invention.
Figure 16:
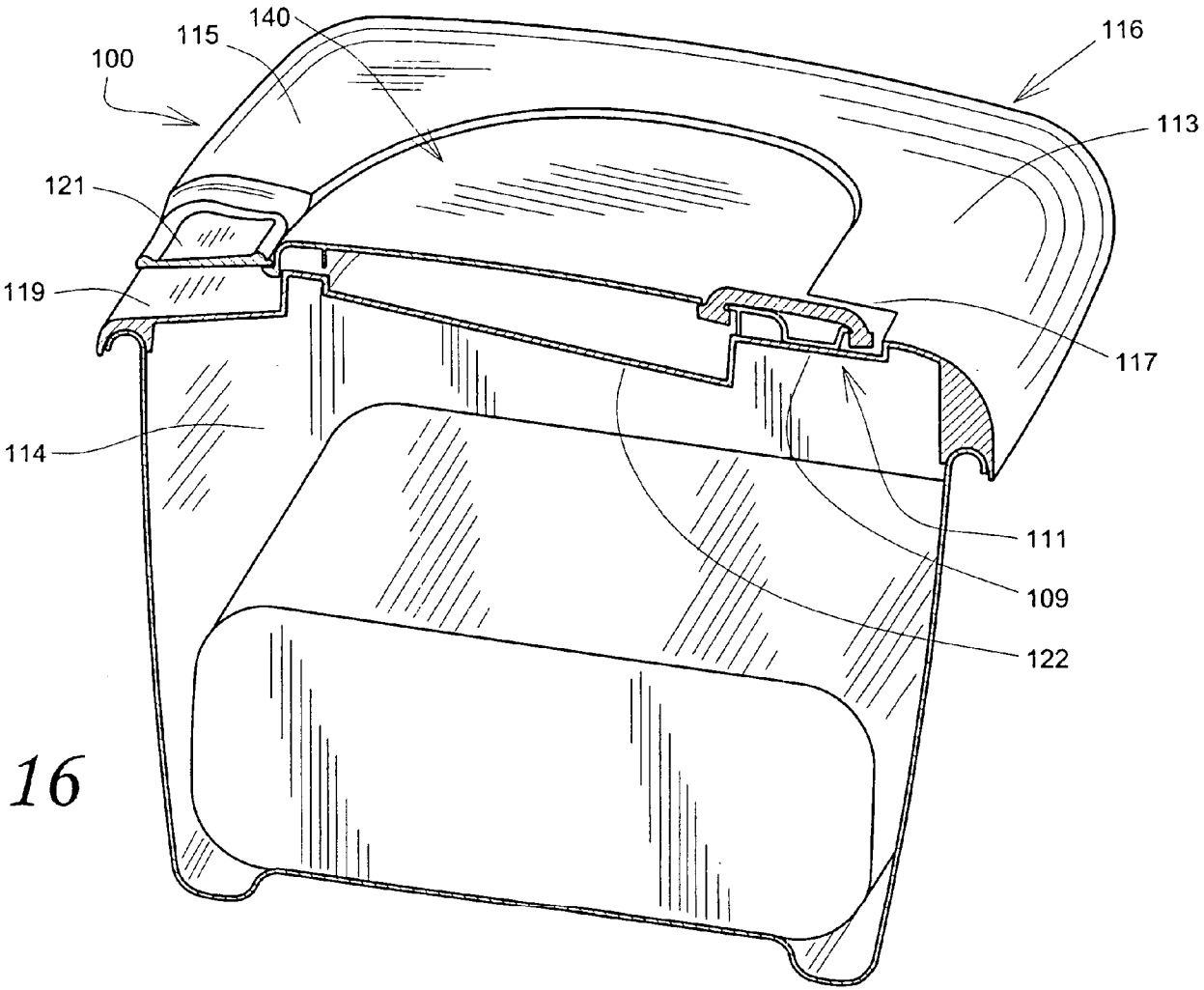
FIG. 16 is a cross-sectional view of the container of FIG. 15.

FIG. 15 shows a container, generally designated by reference number 100, according to another exemplary embodiment of the present invention. As in the previous embodiment, the container 100 includes a bottom 110 and a plurality of walls 112 that define a storage cavity 114 for storing flexible sheets, such as, for example, wet wipes. The container 100 further includes removable primary lid, generally designated by reference number 116 that is placed over the storage cavity 114, and a dispenser lid, generally designated by reference number 140, pivotally attached to the primary lid 116. The primary lid 116 includes a top surface 118, a back portion 113, a front portion 115 and downwardly extending side walls 120. As shown in FIG. 16, which is a cross sectional view of the container 100, the primary lid 116 includes a recessed dispenser portion 122 that permits flexible sheets stored in the storage cavity 114 to be dispensed. In this regard, the dispenser portion may include a flap (not shown) providing access to the flexible sheets, as in the previously-described embodiments of the present invention.

The top surface 118 of the primary lid 116 also includes a first recessed portion 119 at the front portion 115 of the primary lid 116. A catch plate 121 is pivotally attached to the top surface 118 within the recessed portion 119 by, for example, a living hinge. The top surface of the catch plate 121 is generally co-planar with the non-recessed areas of the top surface 118 of the primary lid 116 when the catch plate 121 is in its non-pivoted, biased position.

The top surface 118 of the primary lid 116 further includes a second recessed portion, generally designated by reference number 111, at the back portion 113. The second recessed portion 111 includes a bottom wall 109 and side walls 117.

Figure 17:
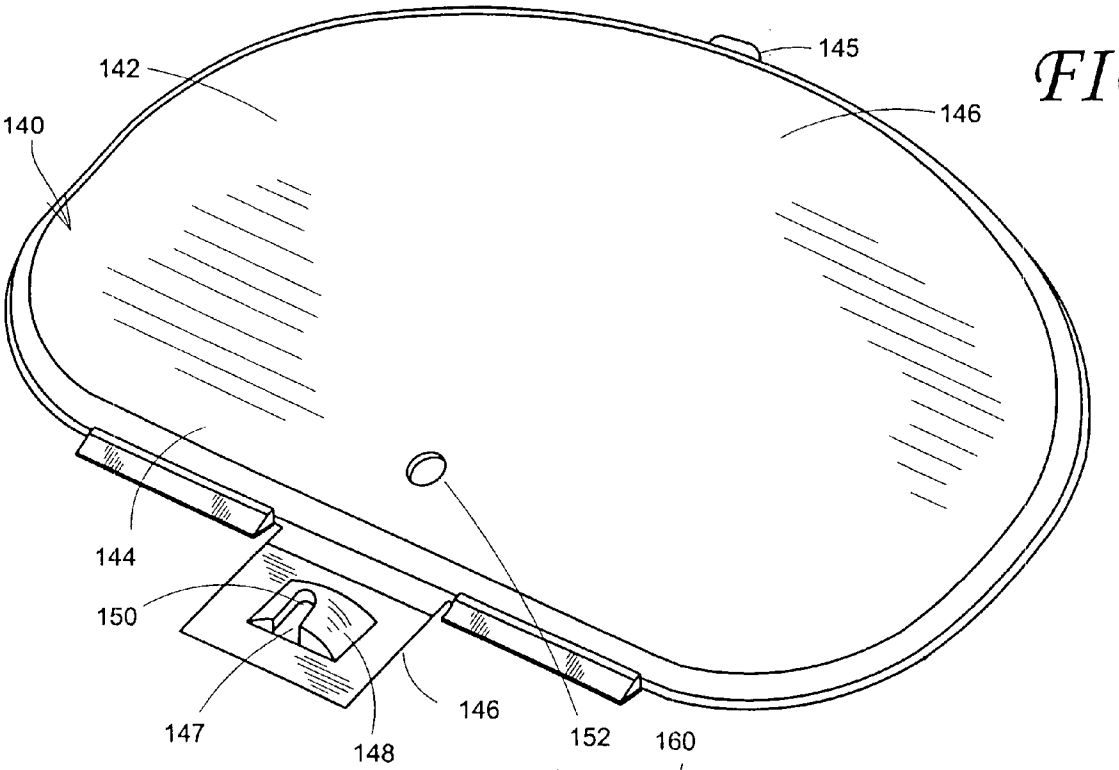
FIG. 17 is a perspective view of a dispenser lid used in the container of FIG. 15.

FIG. 17 shows the dispenser lid 140, including a main dispenser lid portion 142 having a pivot end portion 144 and a free end portion 146. A lock tab 145 extends from the free end portion 146 of the dispenser lid 140. The dispenser lid 140 can be locked in position over the dispenser portion 122 by using the lock tab 145 and catch plate 121, as described previously in regards to earlier embodiments of the invention. The main dispenser lid portion 142 has the same general profile as that of the recessed dispenser portion 122, so that when the dispenser lid 140 is pivoted downwards, it covers the dispenser portion 122 to provide the container 100 with a more compact shape when in storage. A biasing pin anchor tab 146 extends from the pivot end portion 144 of the main dispenser lid portion 142. The biasing pin anchor tab 146 includes a first biasing pin anchor formed by a centrally-located raised portion 148 and an elongated opening 150 that extends through the raised portion 146 to provide the raised portion 146 with an open edge 147. An opening 152 is formed in the main dispenser lid portion 142 to form a second biasing pin anchor.

Figure 18:
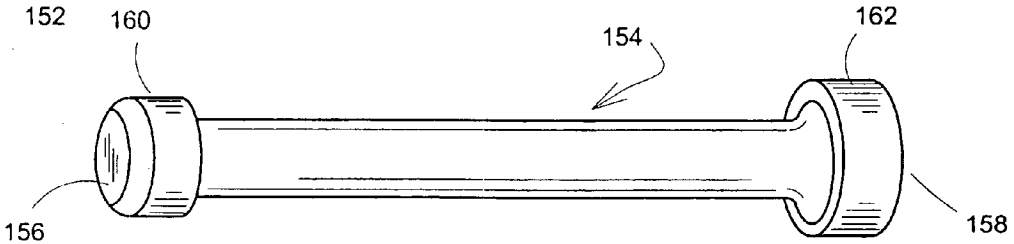
FIG. 18 is a perspective view of a biasing pin of the container of FIG. 15.

As shown in FIG. 18, a biasing pin, generally designated by reference number 154, according to the present embodiment of the invention is generally an elongated element including a first longitudinal end 156 and a second longitudinal end 158. A first flange 160 is formed at the first longitudinal end 156, and a second flange 162 is formed at the second longitudinal end 158. The diameter of the first flange 160 is preferably smaller than that of the opening 152, while the diameter of the second flange 162 is preferably larger than the opening 152.

Figure 20:
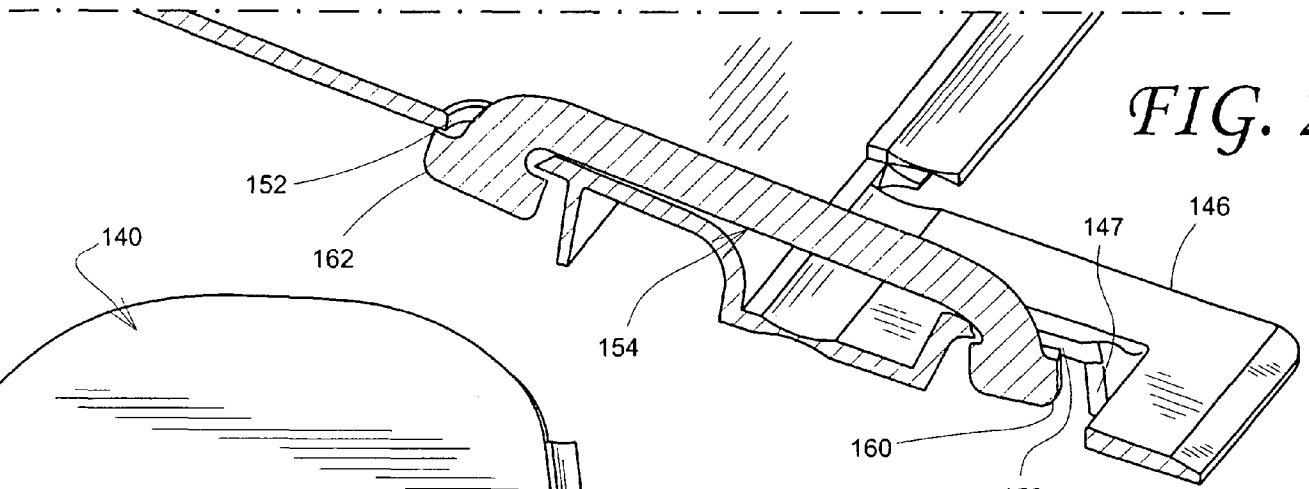
FIG. 20 is a cross-sectional view showing the biasing pin of FIG. 18 being held in position by the dispenser lid of FIG. 17.
Figure 19:
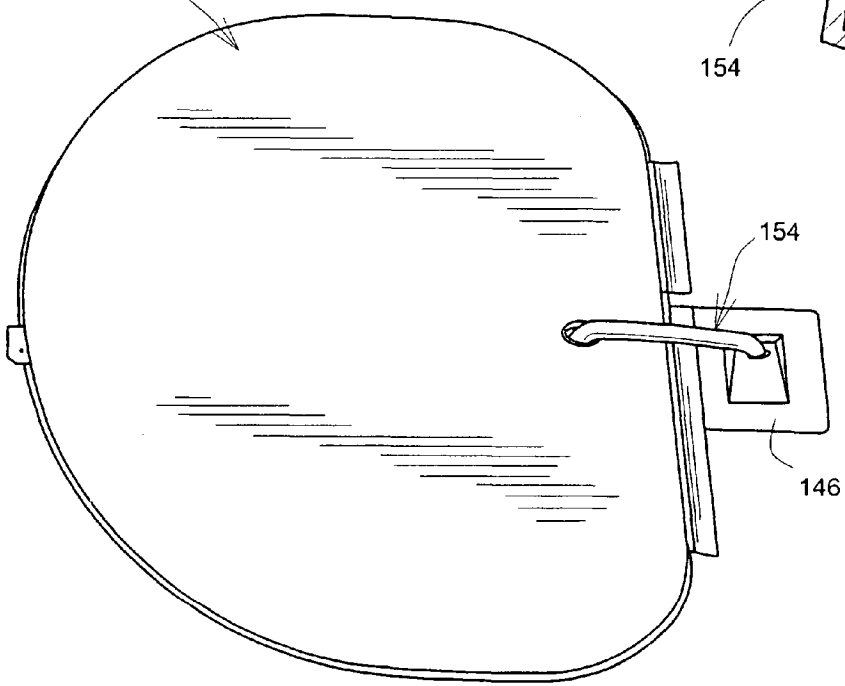
FIG. 19 is a perspective view of the dispenser lid of FIG. 17.

During assembly of the container 100, the biasing pin 154 is inserted from underneath the dispenser lid 140 by "weaving" the first flange 160 through the opening 152 formed in the dispenser lid 140. The biasing pin 154 is then pulled though the opening 152 until the second flange 162 contacts the lower surface of the dispenser lid 140, thereby anchoring the second flange 162 to the dispenser lid 140. The biasing pin 154 is then stretched further so that the first flange 160 can be inserted into the elongated opening 150 through the open edge 147 of the raised portion 146 of the biasing pin anchor tab 146. The fully assembled dispenser lid 140 including the biasing pin 154 is shown in FIGS. 19 and 20. In particular, FIG. 20 is a cross-sectional view showing the biasing pin 154 held in an elongated C-shape due to the first and second flanges 160, 162 being held by the first and second biasing pin anchors.

Figure 21:
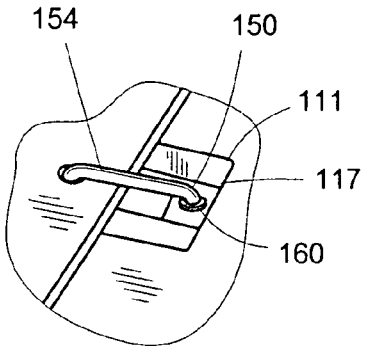
FIG. 21 is a partial detailed perspective view of the container of FIG. 15.

The dispenser lid 140 is pivotally attached to the primary lid 116 by any suitable hinge means, such as through the use of hinge pins, as described previously in regards to prior embodiments of the invention. The biasing pin anchor tab 146 is placed within the second recessed portion 111 of the primary lid 116, and the back side wall 117 of the second recessed portion 111 assists in retaining the first flange 160 of the biasing pin 154 within the elongated opening 150, as shown in FIG. 21. The biasing pin anchor tab 146 may be held in place within the second recessed portion 111 by snap-fit means.

Once the dispenser lid 140 is pivotally attached to the primary lid 116, the tendency of the biasing pin 154 to flex back to its un-stretched condition results in the dispenser lid 40 being biased upwards relative to the primary lid 16. Specifically, when a user pivots the dispenser lid 140 downwards towards the primary lid 116, the biasing pin 154 is stretched between the first and second biasing pin anchors formed in the dispenser lid 140. As described above, the dispenser lid 140 can be locked in the closed position using the catch plate 121. Once the dispenser lid 140 is unlocked, the biasing pin 154 naturally flexes back to its un-stretched condition, thereby urging the dispenser lid 140 to pivot away from the primary lid 116.

Figure 22:
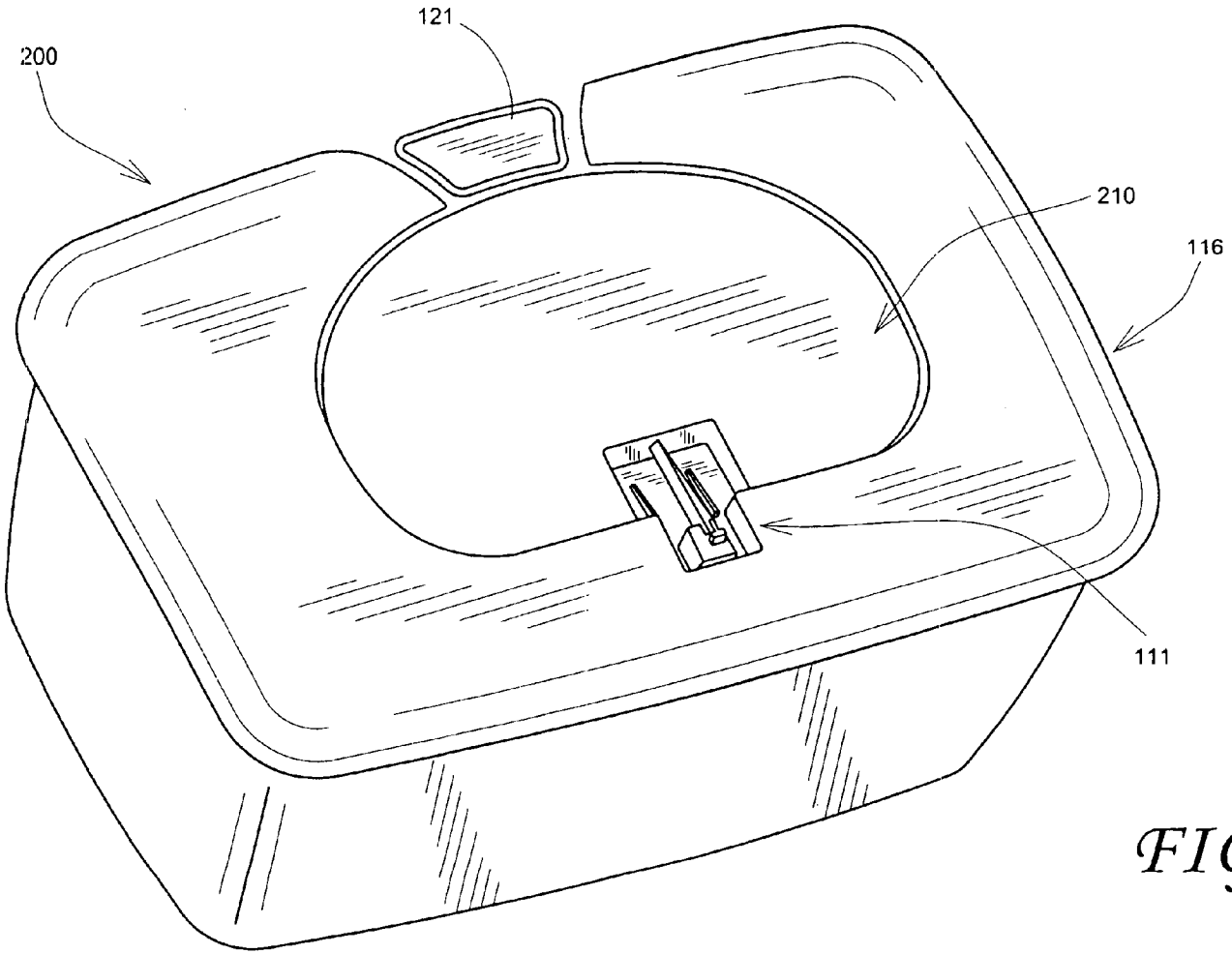
FIG. 22 is a perspective view of a container according to another exemplary embodiment of the present invention.

FIG. 22 shows a container, generally designated by reference number 200, according to another exemplary embodiment of the present invention. The container 200 has the same general construction as that of the previous embodiment, except for the configuration of the biasing means.

Figure 23:
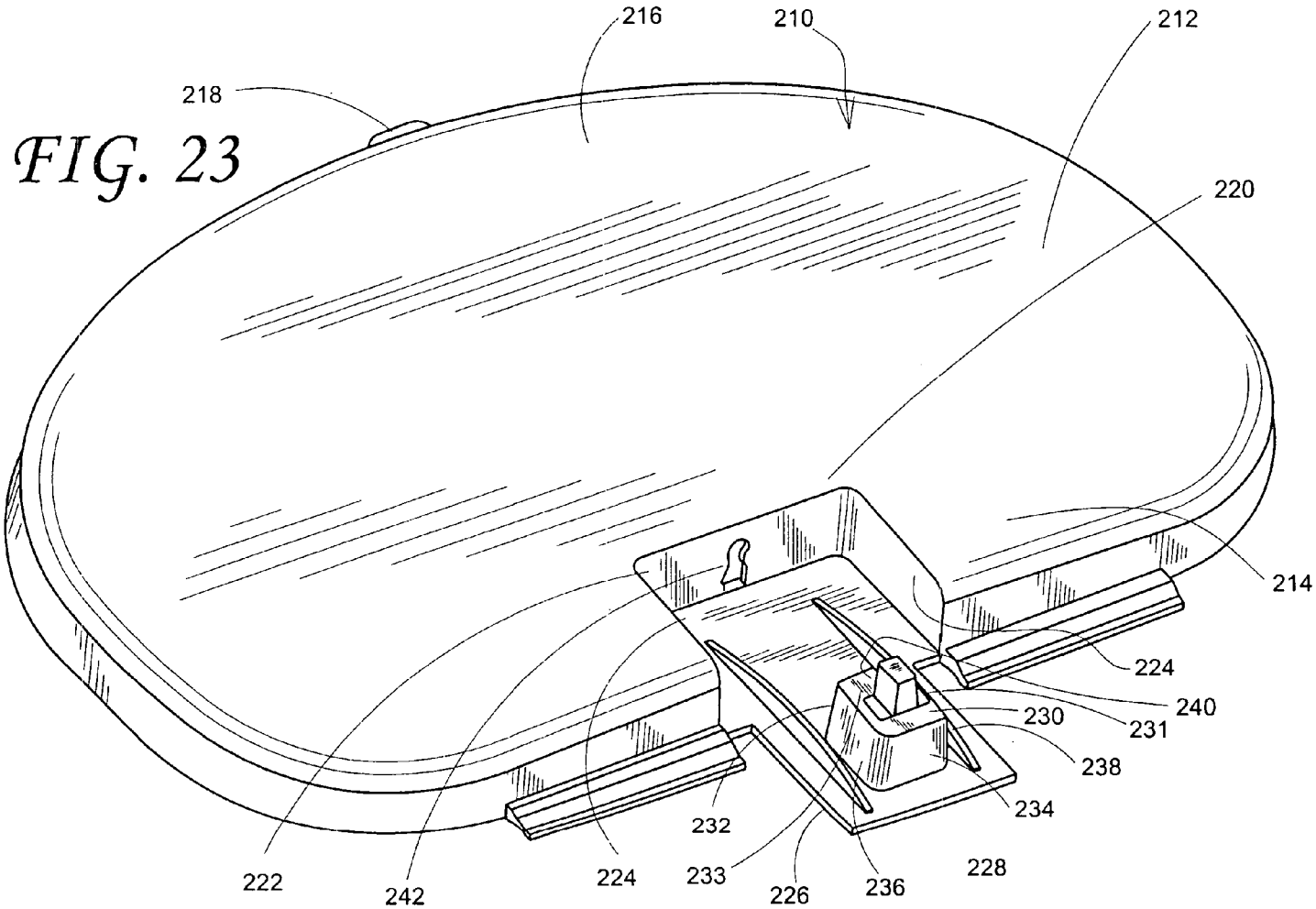
FIG. 23 is a perspective view of a dispenser lid used in the container of FIG. 22.

Specifically, as shown in FIG. 23, the container 200 includes a dispenser lid, generally designated by reference number 210, including a main dispenser lid portion 212 having a pivot end portion 214 and a free end portion 216. A lock tab 218 extends from the free end portion 216 of the dispenser lid 210. The dispenser lid 210 also includes a recessed portion 220 formed at the pivot end portion 214. The recessed portion 220 is in communication with the second recessed portion 111 at the back portion 113 of the primary lid 116 when the dispenser lid 210 is assembled on the primary lid 116. The recessed portion 220 includes a back wall 222 and two side walls 224. A biasing pin anchor tab 226 extends from the pivot end portion 214 of the main dispenser lid portion 212 adjacent to the recessed portion 220. The biasing pin anchor tab 226 includes a vertically extending housing, generally designated by reference number 228, including a top wall 230, front wall 232, back wall 234 and side walls 236, 238, which forms a first biasing pin anchor. The top wall 230 of the housing includes a first opening 231 and a second opening 233 in communication with the first opening 231. The first opening 231 is preferably wider than the second opening 233. The second opening 233 extends to the front edge of the top wall 230 so as to be in communication with a third opening 240 formed in the front wall 232. An opening 242 is formed in the back wall 222 of the recessed portion 220 to form a second biasing pin anchor.

Figure 24:
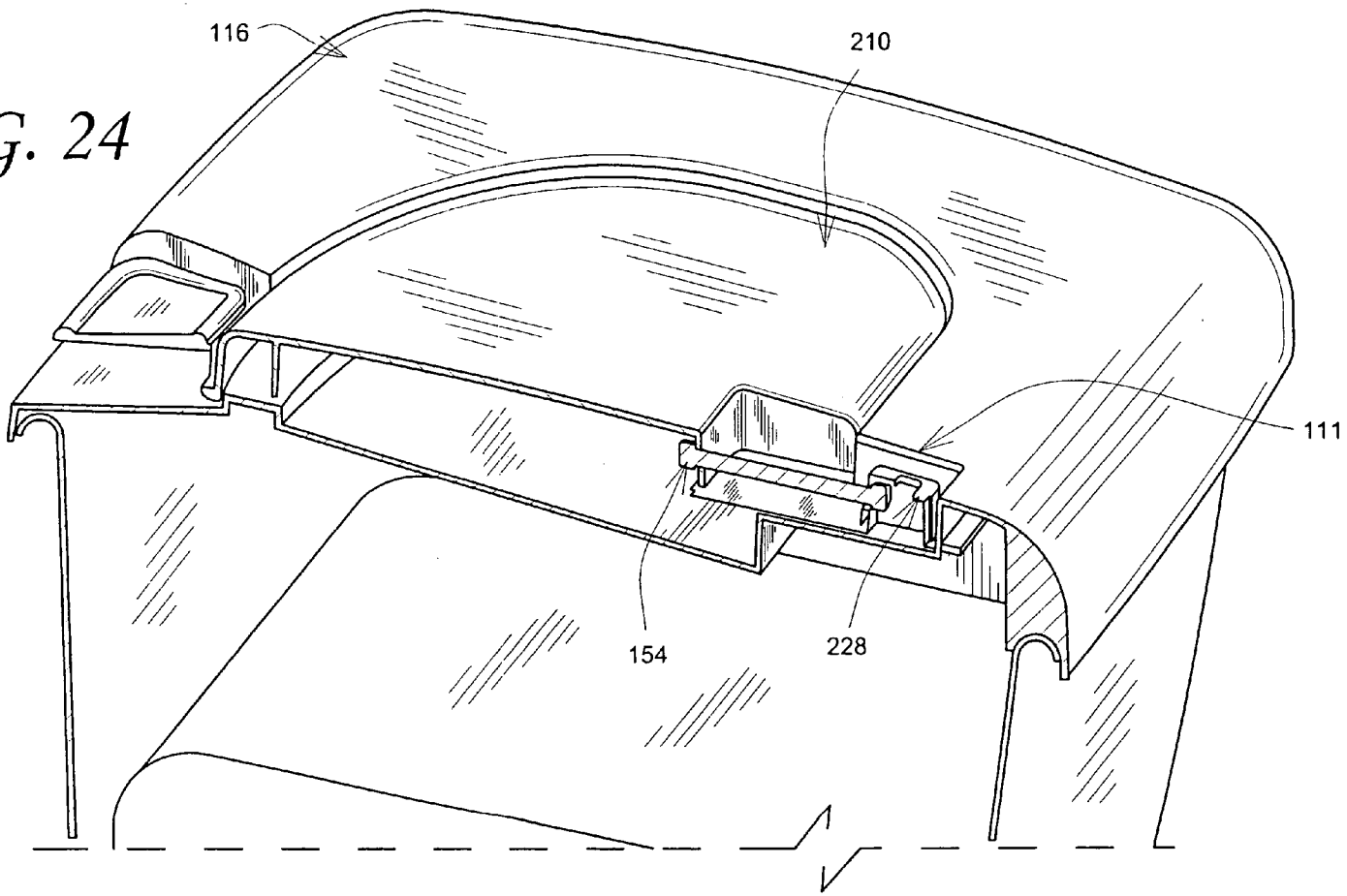
FIG. 24 is a cross-sectional view of the container of FIG. 22.
Figure 25:
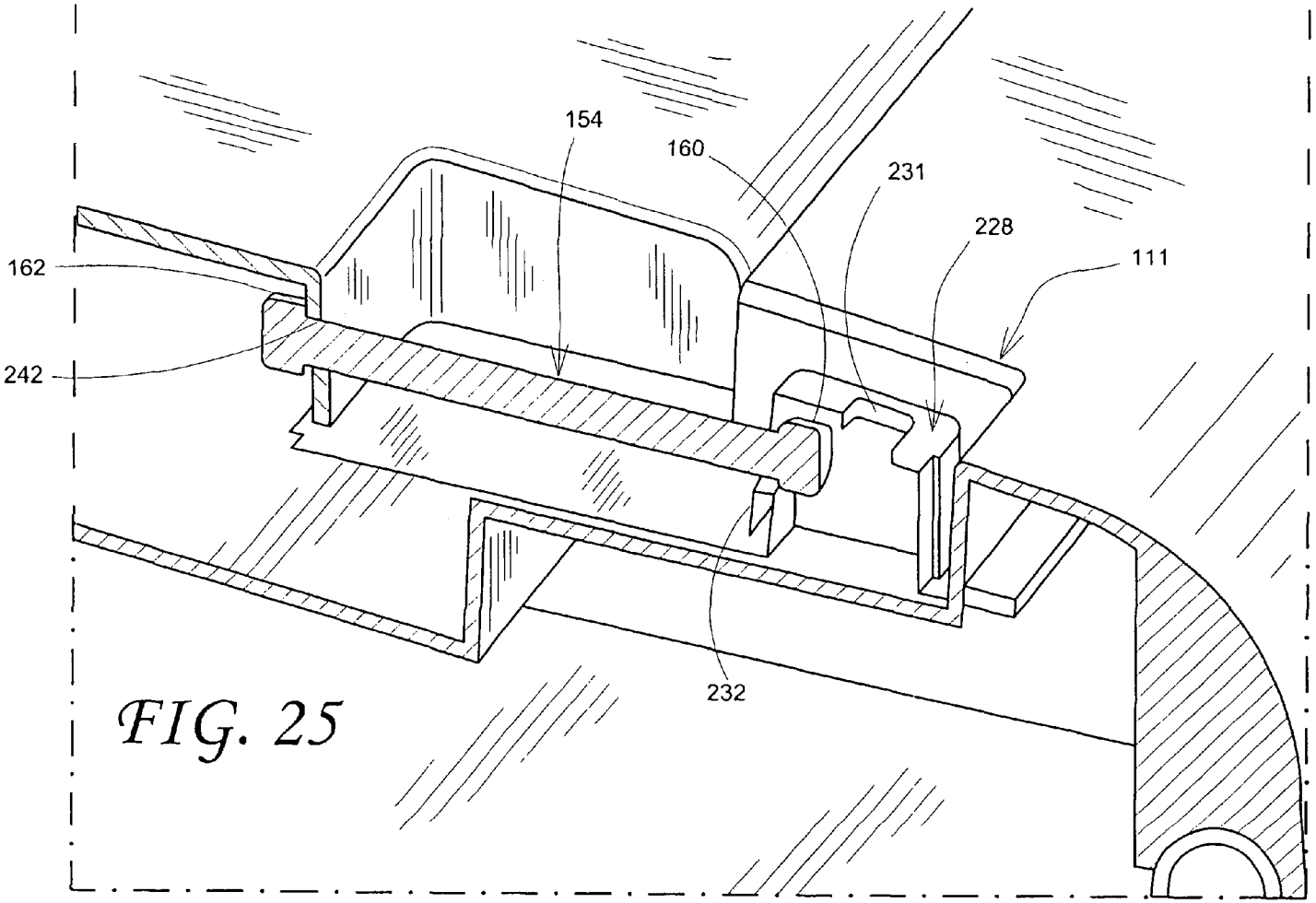
FIG. 25 is a partial detailed cross-sectional view of the container of FIG. 22.
Figure 26:
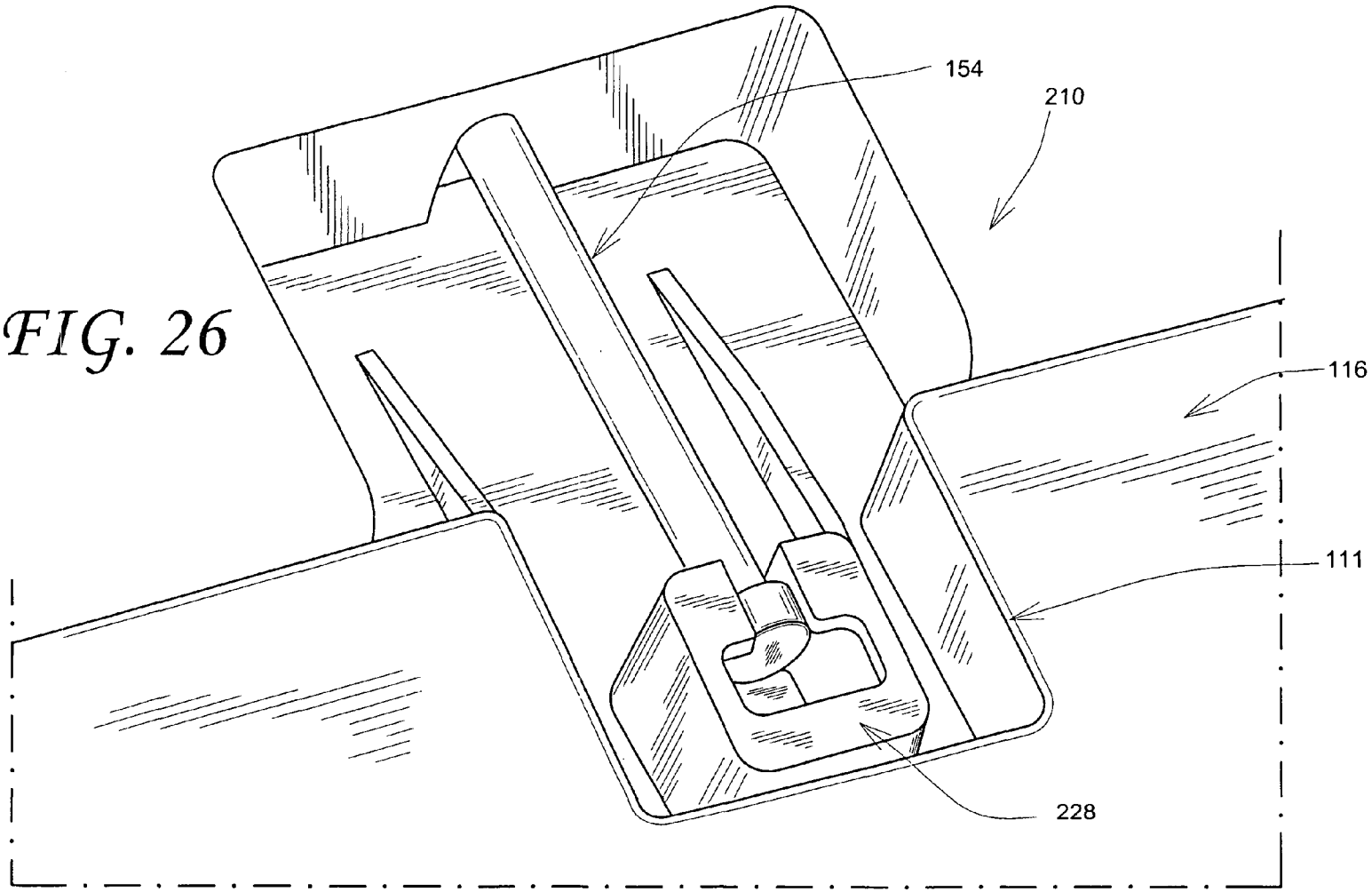
FIG. 26 is a partial detailed perspective view of the container of FIG. 22.

During assembly of the container 200, the biasing pin 154 is inserted from underneath the dispenser lid 210 by "weaving" the first flange 160 through the opening 242 formed in the dispenser lid 210. The biasing pin 154 is then pulled though the opening 242 until the second flange 162 contacts the lower surface of the dispenser lid 210, thereby anchoring the second flange 162 to the dispenser lid 210. The biasing pin 154 is then stretched further so that the first flange 160 can be inserted into the first opening 231 of the housing 228, after which the biasing pin 154 flexes back until the first flange 160 contacts the inner surface of the front wall 232 of the housing 228. The third opening 240 formed in the front wall 232 preferably has a smaller width than that of the first flange 160, so that the first flange 160 is prevented from being pulled out of the housing 228. Various views of the fully assembled dispenser lid 140 including the biasing pin 154 is shown in FIGS. 24-26.

The dispenser lid 210 is pivotally attached to the primary lid 116 by any suitable hinge means, such as through the use of hinge pins, as described previously in regards to prior embodiments of the invention. The biasing pin anchor tab 226 is placed within the second recessed portion 111 of the primary lid 116.

Once the dispenser lid 210 is pivotally attached to the primary lid 116, the tendency of the biasing pin 154 to flex back to its un-stretched condition results in the dispenser lid 210 being biased upwards relative to the primary lid 116. Specifically, when a user pivots the dispenser lid 210 downwards towards the primary lid 116, the biasing pin 154 is stretched between the first and second biasing pin anchors formed in the dispenser lid 210. As described above, the dispenser lid 210 can be locked in the closed position using the catch plate 121. Once the dispenser lid 210 is unlocked, the biasing pin 154 naturally flexes back to its un-stretched condition, thereby urging the dispenser lid 210 to pivot away from the primary lid 116.

It should be appreciated that the structure of the container according to the present invention is not limited to the various embodiments described herein. The present invention is intended to cover the general construction of a biasing pin useable with a container lid to urge the container lid towards an open position relative to another container element, such as another container lid.

Figure 27:
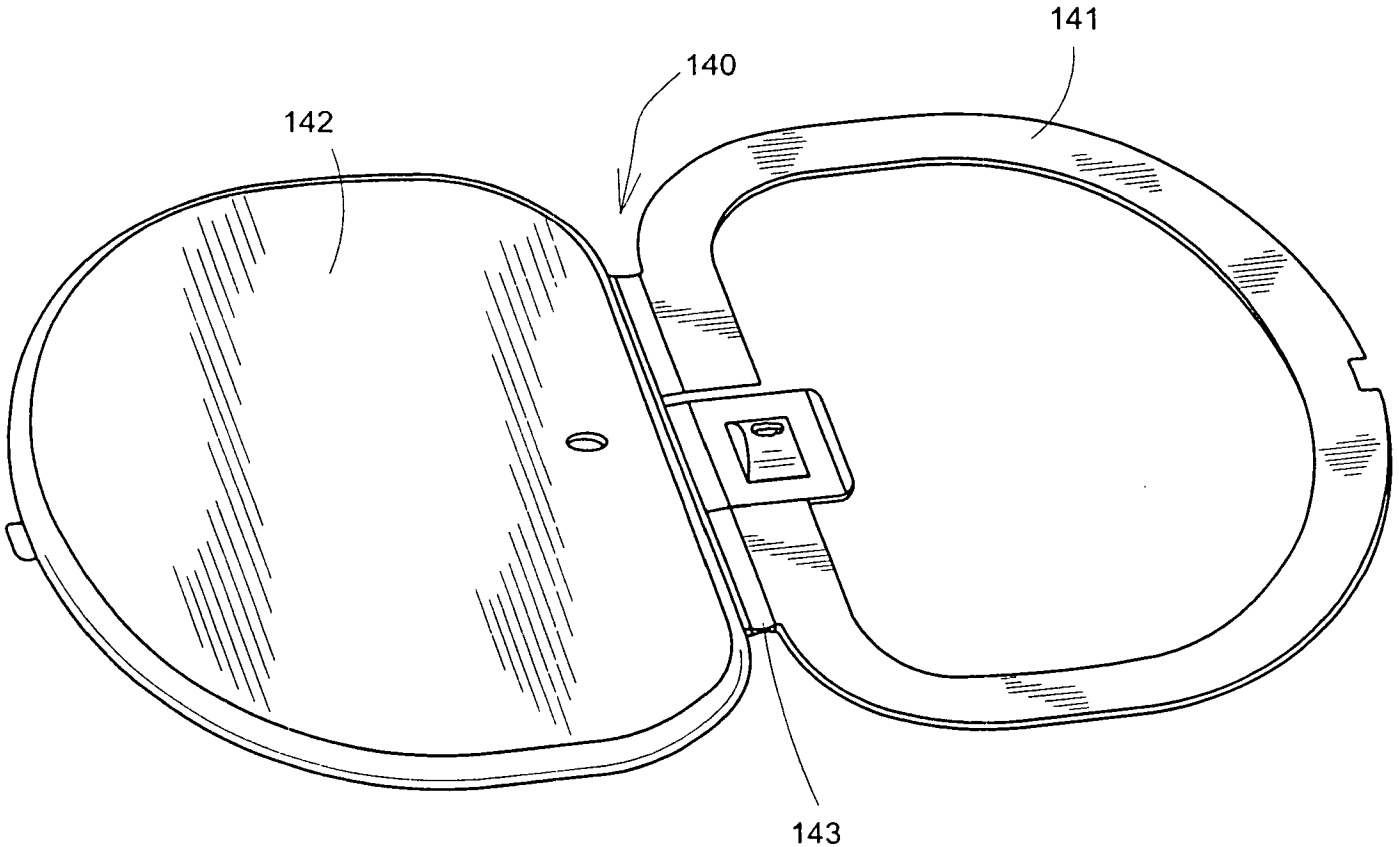
FIG. 27 is a top perspective view of the dispenser lid used in the container of FIG. 15 after a molding process.
Figure 28:
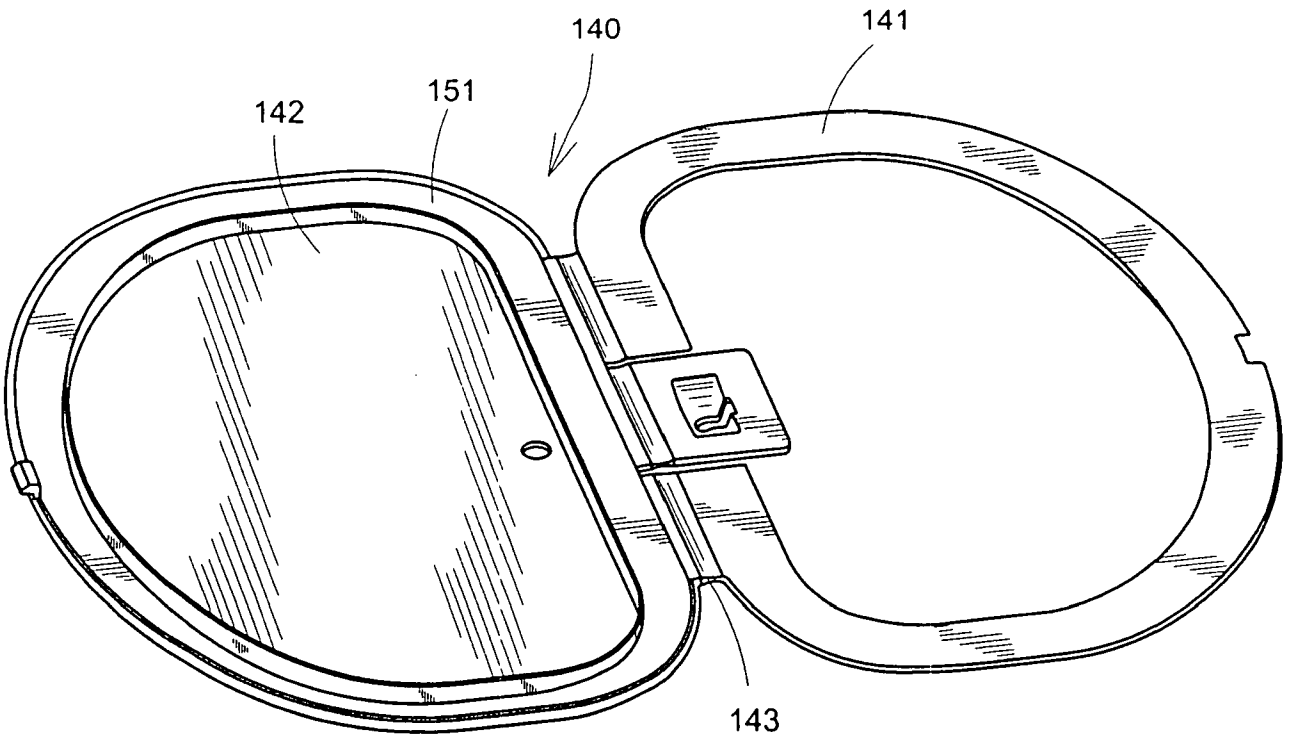
FIG. 28 is a bottom perspective view of the dispenser lid used in the container of FIG. 15 after a molding process.
Figure 29:
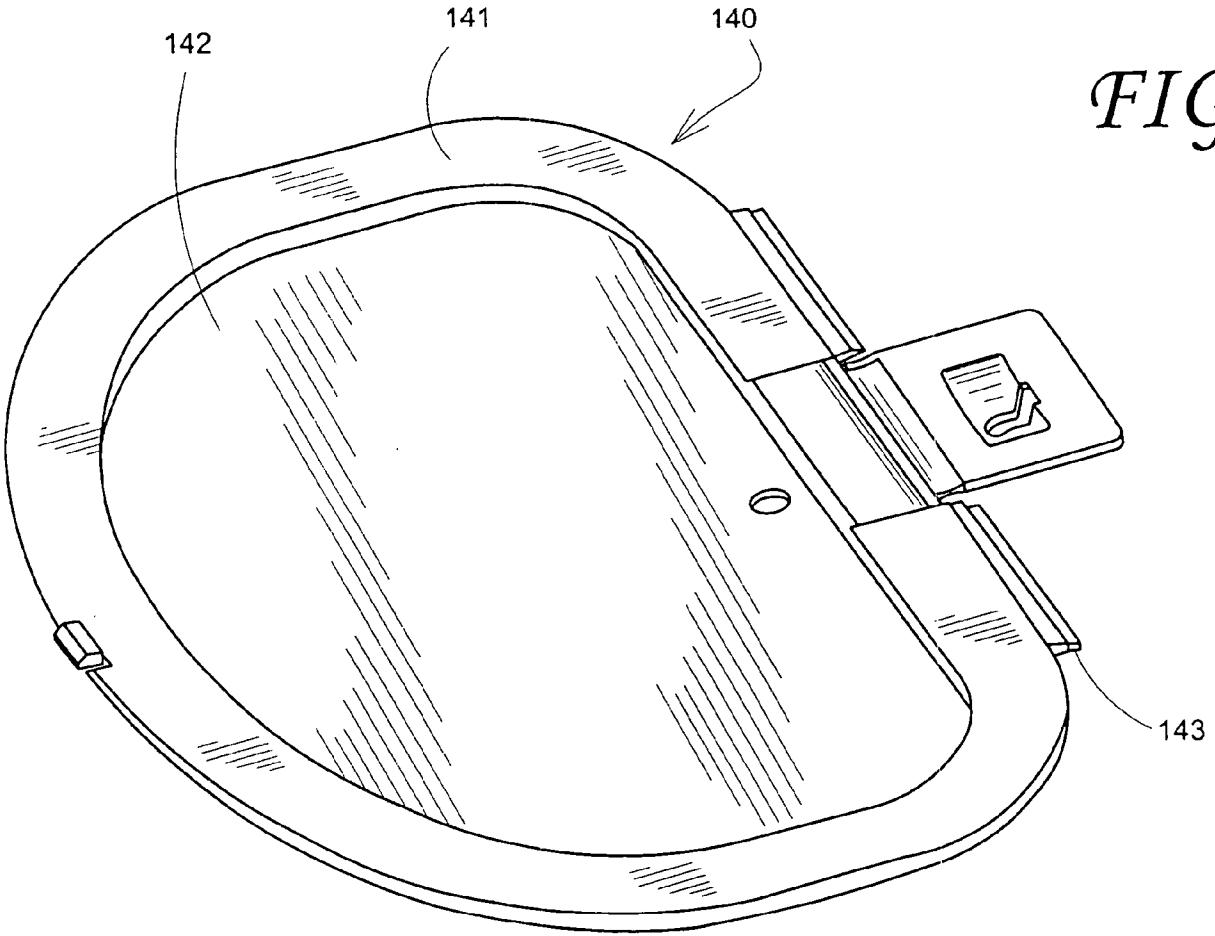
FIG. 29 is a bottom perspective view of the fully assembled dispenser lid used in the container of FIG. 15.

FIGS. 27-29 show a method of forming the dispenser lid 140 according to an exemplary embodiment of the invention. As shown in FIGS. 27 and 28, a mold is used to form the dispenser lid 140 such that a bottom rim member 141 of the dispenser lid 140 is formed co-planar with the main dispenser lid portion 142. FIG. 27 is a top perspective view of the dispenser lid 140 after the molding process, and FIG. 28 is a bottom perspective view of the dispenser lid 140 after the molding process. The molding process results in the formation of a recessed groove 151 around the perimeter of the bottom surface of the main dispenser lid portion 142 and a living hinge 143 between the bottom rim member 141 and the main dispenser lid portion 142. As shown in FIG. 29, the bottom rim member 141 is then folded about the living hinge 143 such that the bottom rim member 141 is disposed in face-to-face contact with the recessed groove 151. The dispenser lid 210 can also be formed using a similar molding process.

Figure 32:
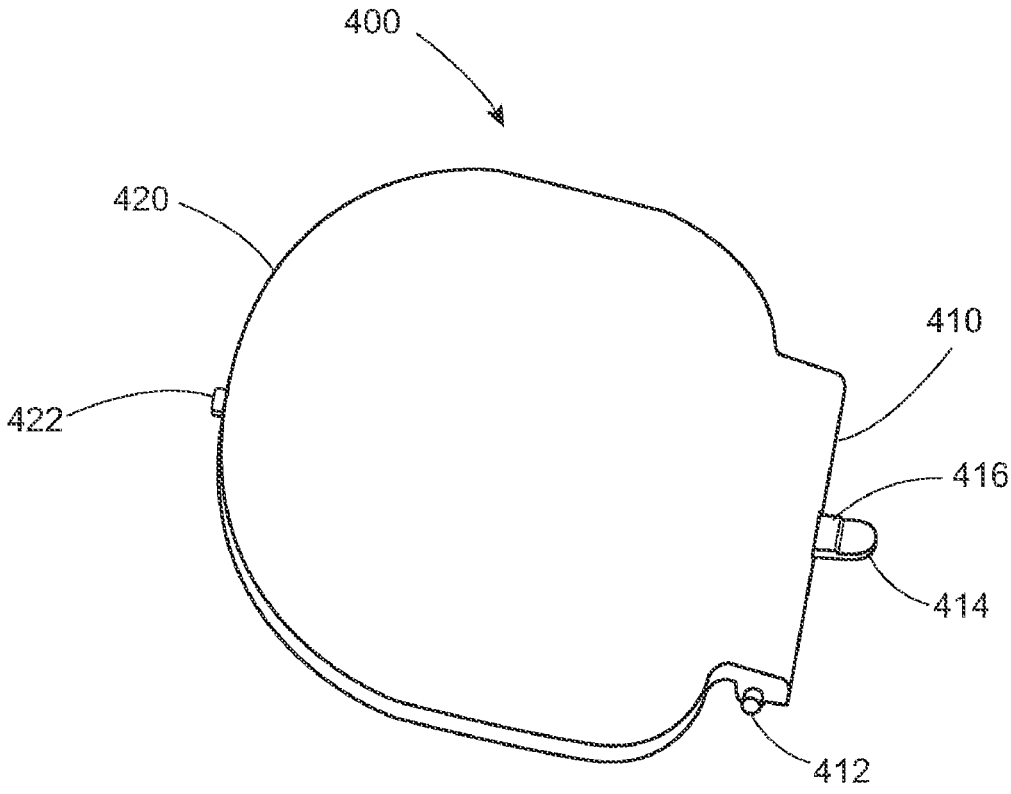
FIG. 32 is a perspective view of a dispenser lid according to an exemplary embodiment of the present invention.
Figure 33:
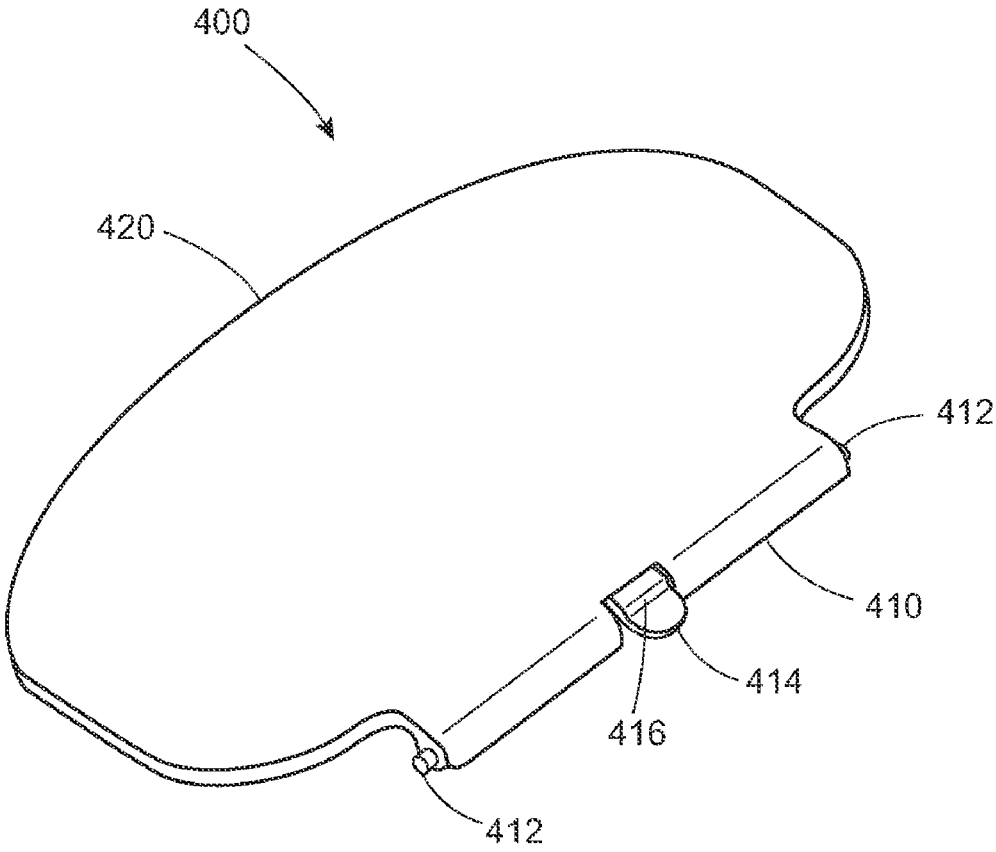
FIG. 33 is another perspective view of the dispenser lid of FIG. 32.

In other embodiments of the present invention, the dispenser lid and the biasing pin may be formed as a unitary structure, so as to avoid the need to separately install the biasing pin onto the dispenser lid during assembly of a container. FIGS. 32 and 33 are perspective views of a dispenser lid, generally designated by reference number 400, according to an exemplary embodiment of the present invention. The dispenser lid 400 has the same general profile as in the previously described embodiments, and includes a pivot end portion 410 and a free end portion 420. A tab 422 extends from the free end portion 420 and may be used to lock the dispenser lid 400 in position over a dispenser portion of a container, as described in previous embodiments. Pivot pins 412 extend from the lateral sides of pivot end portion 410 and may be inserted into associated pivot pin receptacles of a primary lid or container top to allow the dispenser lid 400 to pivot in relation to the primary lid/container top. A biasing pin 414 extends from the pivot end portion 410 of the dispenser lid 400. The biasing pin 414 may have the same general profile as any of the other previously described biasing pins, with the exception of the biasing pin 414 being integrally formed with the remaining portions of the dispenser lid 400. Thus, for example, similar to the embodiment shown in and described with reference to FIG. 10, the basing pin 414 may include a flanged portion 416 that can be pulled through an opening in a primary lid so as to anchor the dispenser lid 400 to the primary lid and allow the biasing pin 414 to function as a spring in biasing the dispenser lid 400 towards the open configuration.

The biasing pin 414 is preferably made of a more flexible material than that of the other portions of the dispenser lid 400 so as to allow the biasing pin 414 to be inserted into a primary lid and/or to function as a spring member in biasing the dispenser lid 400 towards an open configuration. For example, the biasing pin 414 may be made of an elasticized material, such as, for example, silicone, while the other portions of the dispenser lid 400 may be made of a hard plastic resin, such as, for example, polypropylene. Alternatively, the biasing pin 414 may be made of the same material as that of the other portions of the dispenser lid 400.

Although the biasing pin 414 may be made of a different material from that of the other portions of the dispenser lid 400, it would be advantageous to provide a method of forming a unitary dispenser lid including a biasing pin during a single molding operation. Thus, the unitary dispenser lid 400 may be formed with the biasing pin 414 using an injection molding technique. Preferably, the injection molding technique used to form the dispenser lid 400 is a two-shot molding technique, in which two different materials (one material to form the biasing pin 414, the other material to form the remaining portions of the dispenser lid 400) are injected into the same mold before the mold is opened for part removal. The two different materials may be shot into the mold either simultaneously or at different times, and either using a dual runner system or a single runner system.

Figure 30:
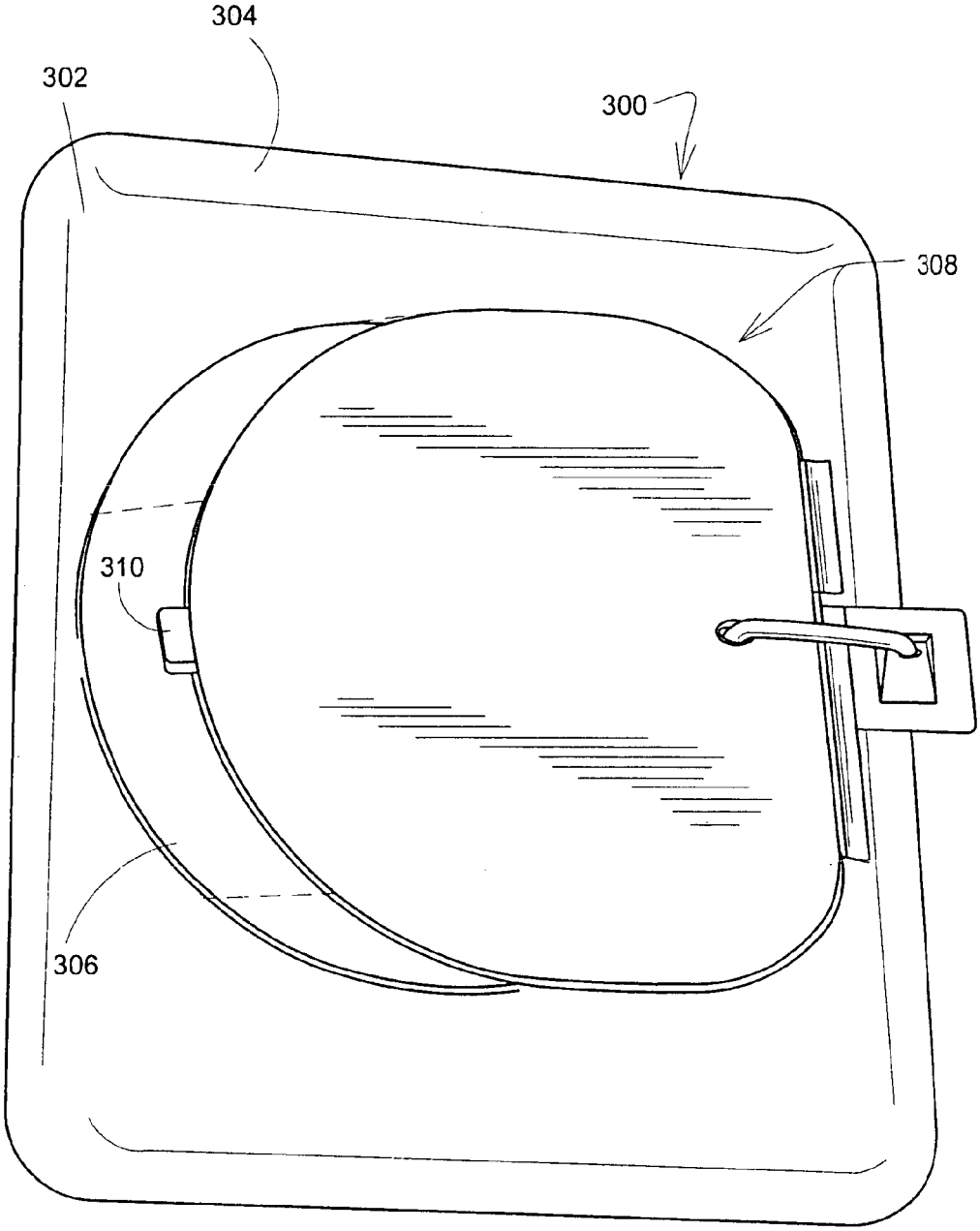
FIG. 30 is an exploded view of a container according to another exemplary embodiment of the present invention.
Figure 31:
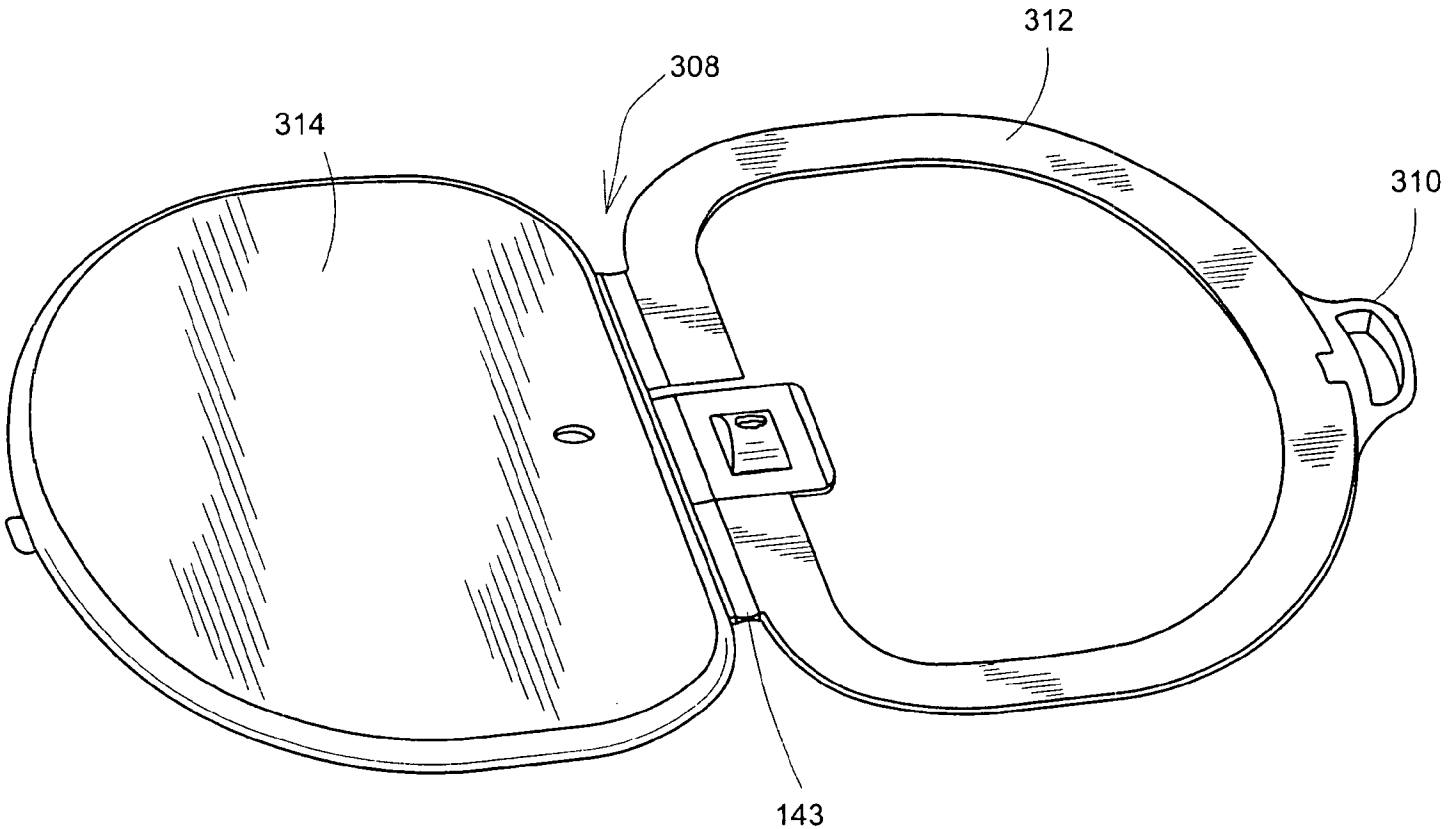
FIG. 31 is a to perspective view of the dispenser lid used in the container of FIG. 30 after a molding process.

It should be appreciated that the dispenser lid of the present invention is not limited to use with a corresponding container lid or with a specific container type. For example, any of the previously described exemplary embodiments of the dispenser lid of the present invention may be applied to a bag-like structure, as shown in FIG. 30. In particular, FIG. 30 shows a container, generally designated by reference number 300, including a flexible bag, generally designated by reference number 302, having an upper surface 304. The upper surface 304 may include an opening 306 or a perforated portion that can be later removed by a user to form an opening, as is well known in the art of flexible bags for wet wipes. A dispenser lid, generally designated by reference number 308, is disposed over the opening 306 formed in the flexible bag 302. The dispenser lid 308 may have the same general construction as the lid shown in and an previously described with reference to FIGS. 15-21 and 27-29, except that the bottom rim member 312 is not fixed to the bottom surface of the main dispenser lid portion 314 and a catch plate 310 is preferably integrally molded with the bottom rim member 312 of the dispenser lid 308, as best shown in FIG. 31. The catch plate 310 locks the dispenser lid 308 in the closed position, and the dispenser lid 308 can be unlocked by simply pressing down on the catch plate 310, allowing the main dispenser lid portion 314 to pivot upwards relative to the bottom rim member 312. The bottom rim member 312 of the dispenser lid 308 may be adhered to the flexible bag 302 by any suitable means, such as, for example, adhesive or sonic welding. In other embodiments, the dispenser lid 308 may have the same construction as the lid shown in and previously described with reference to FIGS. 22-26. Further, the dispenser lid 308 may be made with an integral biasing pin using a molding operation, as described with reference to FIGS. 32 and 33.

Now that the preferred embodiments have been shown and described in detail, various modifications and improvements thereon will be readily apparent to those skilled in the art. Accordingly, the spirit and scope of the present invention is to be construed broadly and be limited only by the appended claims, and not by the foregoing specification.

What is claimed is:

1. A container comprising:

a bottom and a plurality of walls that form a storage cavity;

a primary lid disposed over the storage cavity and having an opening extending entirely through the primary lid, the primary lid including a top surface that defines a dispenser portion through which items within the storage cavity may be dispensed;

a dispenser lid pivotally attached to the primary lid, the dispenser lid having a closed position in which the dispenser lid is pivoted downwards relative to the primary lid to cover the dispenser portion and an open position in which the dispenser lid is pivoted upwards relative to the primary lid to expose the dispenser portion, the dispenser lid comprising:

a pivot end portion and an opposite free end portion; and a biasing pin extending from the pivot end portion, the biasing pin having a longitudinal end portion inserted through the opening in the primary lid so that the biasing pin is anchored to the primary lid and the biasing pin urges the dispenser lid towards the open position, the dispenser lid and the biasing pin forming a unitary structure.

2. The container of claim 1, wherein the biasing pin further comprises:

a first flange formed at the longitudinal end portion; and a second flange longitudinally spaced from the first flange to thereby form a groove between the first and second flanges, the width of the second flange gradually increasing towards the groove, the end portion of the biasing pin being inserted into the opening formed in the primary lid such that edges of the top wall that define the opening are inserted into the groove.

3. The container of claim 1, further comprising a catch plate disposed on the primary lid that locks the dispenser lid in the closed position.

4. The container of claim 1, wherein the biasing pin is made of a material that is different from that of a material used to form the remainder of the dispenser lid.

5. The container of claim 1, wherein the plurality of walls are flexible.

* * * * *